US012747484B2

(12) United States Patent
Sakiyama et al.

(10) Patent No.: US 12,747,484 B2
(45) Date of Patent: Sep. 29, 2026

(54) STEEL SHEET FOR HOT STAMPING

(71) Applicant: NIPPON STEEL CORPORATION, Tokyo (JP)

(72) Inventors: Yuji Sakiyama, Tokyo (JP); Akinobu Kobayashi, Tokyo (JP); Takayuki Harano, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 608 days.

(21) Appl. No.: 17/801,963

(22) PCT Filed: May 13, 2021

(86) PCT No.: PCT/JP2021/018158

§ 371 (c)(1),
(2) Date: Aug. 24, 2022

(87) PCT Pub. No.: WO2021/230309

PCT Pub. Date: Nov. 18, 2021

(65) Prior Publication Data

US 2023/0078655 A1 Mar. 16, 2023

(30) Foreign Application Priority Data

May 13, 2020 (JP) ..... 2020-084584

(51) Int. Cl.
*C21D 9/46* (2006.01)
*B21D 22/02* (2006.01)
(Continued)

(52) U.S. Cl.
CPC ..... *C21D 9/46* (2013.01); *B21D 22/022* (2013.01); *C22C 21/02* (2013.01); *C22C 38/001* (2013.01);
(Continued)

(58) Field of Classification Search
CPC ..... C21D 9/46; B21D 22/022; C22C 21/02; C22C 38/001; C22C 38/002; C22C 38/02;
(Continued)

(56) References Cited

U.S. PATENT DOCUMENTS

2006/0147336 A1 7/2006 Sugahara
2010/0003163 A1 1/2010 Kloewer et al.
(Continued)

FOREIGN PATENT DOCUMENTS

CN 107429342 A 12/2017
CN 107904535 A * 4/2018 ..... B32B 15/012
(Continued)

OTHER PUBLICATIONS

English machine translation of WO-2019003543-A1 of Funakawa (Year: 2019).*

(Continued)

*Primary Examiner* — Rebecca Janssen
*Assistant Examiner* — Mayela Aldaz
(74) *Attorney, Agent, or Firm* — Birch, Stewart, Kolasch & Birch, LLP

(57) ABSTRACT

This steel sheet for hot stamping includes a base material, an Al—Si alloy plating layer in which the Al content is 75 mass % or more, the Si content is 3 mass % or more and the total of the Al content and the Si content is 95 mass % or more, an Al oxide coating having a thickness of 0 to 20 nm and a Ni plating layer in which the Ni content is more than 90 mass % in this order, the base material has a predetermined chemical composition, the Al—Si alloy plating layer has a thickness of 7 to 148 μm, and the Ni plating layer has a thickness of more than 200 nm and 2500 nm or less.

10 Claims, 1 Drawing Sheet

(51) Int. Cl.

| | |
|---|---|
| ***C22C 21/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/60*** | (2006.01) |
| ***C23C 2/26*** | (2006.01) |
| ***C23C 28/00*** | (2006.01) |
| ***C25D 3/12*** | (2006.01) |
| ***C25D 3/44*** | (2006.01) |

(52) U.S. Cl.
CPC ..... *C22C 38/002* (2013.01); *C22C 38/02* (2013.01); *C22C 38/04* (2013.01); *C22C 38/06* (2013.01); *C22C 38/60* (2013.01); *C23C 2/26* (2013.01); *C23C 28/321* (2013.01); *C25D 3/12* (2013.01); *C25D 3/44* (2013.01)

(58) Field of Classification Search
CPC ..... C22C 38/04; C22C 38/06; C22C 38/60; C23C 2/26; C23C 28/321; C25D 3/12; C25D 3/44
See application file for complete search history.

(56) References Cited

U.S. PATENT DOCUMENTS

| | | | | |
|---|---|---|---|---|
| 2014/0030544 | A1* | 1/2014 | Maki | C22C 38/04 428/653 |
| 2016/0059343 | A1* | 3/2016 | Nam | B23K 11/14 219/93 |
| 2016/0222485 | A1 | 8/2016 | Murakami et al. | |
| 2017/0253941 | A1 | 9/2017 | Cobo et al. | |
| 2018/0029102 | A1* | 2/2018 | Omori | B21D 22/022 |
| 2019/0144963 | A1 | 5/2019 | Georges et al. | |
| 2020/0024683 | A1 | 1/2020 | Yokoi et al. | |

FOREIGN PATENT DOCUMENTS

| | | | | |
|---|---|---|---|---|
| EP | 3 712 293 | A1 | 9/2020 | |
| JP | 4-246182 | A | 9/1992 | |
| JP | 06346277 | A * | 12/1994 | |
| JP | 11269664 | A * | 10/1999 | B23K 35/0261 |
| WO | WO 2016/016707 | A1 | 2/2016 | |
| WO | WO 2017/187255 | A1 | 11/2017 | |
| WO | WO-2019003543 | A1 * | 1/2019 | B21D 22/022 |
| WO | WO 2021/230306 | A1 | 11/2021 | |
| WO | WO 2021/230311 | A1 | 11/2021 | |

OTHER PUBLICATIONS

English machine translation of CN-107904535-A of Dong (Year: 2018).*

English machine translation of JP-06346277-A of Tosaka (Year: 1994).*

English machine translation of JP-11269664-A of Kurosaki (Year: 1999).*

Ungár et al., "The contrast factors of dislocations in cubic crystals: the dislocation model of strain anisotropy in practice", Journal of Applied Crystallography, 1999, vol. 32, pp. 992-1002.

* cited by examiner

STEEL SHEET FOR HOT STAMPING

TECHNICAL FIELD

The present invention relates to a steel sheet for hot stamping. Priority is claimed on Japanese Patent Application No. 2020-084584, filed May 13, 2020, the content of which is incorporated herein by reference.

BACKGROUND ART

In recent years, there has been a demand for the weight reduction of automotive vehicle bodies from the viewpoint of environmental protection and resource saving, and the application of high strength steel sheets to automotive members has been accelerating. Automotive members are manufactured by press forming, and an increase in the strength of steel sheets does not only increase forming loads but also degrades formability, which creates a problem with the formability of high strength steel sheets into members with a complicated shape. In order to solve such a problem, the application of hot stamping techniques, in which a steel sheet is heated to a high temperature in an austenite region where the steel sheet softens and then formed by pressing, is underway. Hot stamping is drawing attention as a technique in which a quenching treatment is carried out in a die at the same time as pressing, thereby satisfying both formability into automotive members and the securement of the strength of automotive members.

In a case where hot stamping is carried out on a steel sheet that is a bare material on which plating or the like has not been carried out, there is a need to carry out hot stamping in a non-oxidative atmosphere in order to suppress the formation of scale during heating and the decarburization of the surface layer. However, even when hot stamping is carried out in a non-oxidative atmosphere, the steel sheet is in the atmospheric atmosphere when the steel sheet is conveyed from a heating furnace to a pressing machine, thus, a scale is formed on the surface of the hot-stamped steel sheet. The scale on the surface of the steel sheet is poorly adhesive and easily exfoliates, which creates a concern of an adverse influence on other steps. Therefore, there is a need to remove the scale by shot blasting or the like. Shot blasting has a problem of affecting the shapes of steel sheets. In addition, there is a problem in that the productivity of a hot stamping step deteriorates due to a scale removal step.

In order to improve the adhesion of scale on the surface of a steel sheet, there is a method in which plating is formed on the surface of the steel sheet. When plating is formed, since scale that is formed on the surface of a steel by hot stamping has favorable adhesion, a step of removing scale becomes unnecessary. Therefore, the productivity of the hot stamping step is improved.

As a method for forming plating on the surface of a steel sheet, a method in which Zn plating or Al plating is formed is conceivable; however, in a case where Zn plating is used, there is a problem with liquid metal embrittlement (hereinafter, referred to as LME). LME refers to a phenomenon in which, when tensile strength is imparted with a liquid metal in contact with the surface of a solid metal, the solid metal that intrinsically exhibits ductility embrittles. Zn has a low melting point, molten Zn intrudes along prior austenite grain boundaries of Fe during hot stamping, and micro-cracks are initiated in steel sheets.

In a case where Al plating is provided on a steel sheet, the above-described LME problem is not caused, but a reaction is caused between Al and water on the surface of the Al plating during hot stamping, and hydrogen is generated. Therefore, there is a problem in that the amount of intruding hydrogen into the steel sheet is large. When the amount of hydrogen intruding into the steel sheet is large, stress that is loaded after hot stamping leads to cracking of the steel sheet (hydrogen embrittlement).

Patent Document 1 discloses a technique for suppressing the intrusion of hydrogen into steel at a high temperature by enriching nickel in the surface layer region of a steel sheet.

Patent Document 2 discloses a technique for suppressing the intrusion of hydrogen into steel by coating a steel sheet with a barrier pre-coat containing nickel and chromium and having a weight ratio Ni/Cr of 1.5 to 9.

However, in the method of Patent Document 1, there has been a case where it is not possible to sufficiently suppress the intrusion of hydrogen that is generated in the case of providing Al plating. In addition, in the method of Patent Document 2, there has been a case where it is not possible to sufficiently suppress the intrusion of hydrogen into a steel sheet in an environment where the dew point is not controlled (for example, in a high-dew point environment such as 30° C.).

CITATION LIST

Patent Document

[Patent Document 1] PCT International Publication No. WO 2016/016707

[Patent Document 2] PCT International Publication No. WO 2017/187255

Non-Patent Document

[Non-Patent Document 1] T. Ungar and three coauthors, Journal of Applied Crystallography (1999), Volume 32 (PP. 992 to 1002)

SUMMARY OF THE INVENTION

Problems to be Solved by the Invention

The present invention is an invention made in consideration of the above-described problem, and an objective of the present invention is to provide a steel sheet for hot stamping having excellent hydrogen embrittlement resistance by suppressing the intrusion of hydrogen into the steel sheet even in a high-dew point environment even in the case of hot-stamping the steel sheet provided with Al plating.

Means for Solving the Problem

As a result of intensive studies, the present inventors found that, when a steel sheet for hot stamping including an Al—Si alloy plating layer includes a Ni plating layer having a desired average layer thickness (thickness) and containing a desired amount of Ni, and an Al oxide coating on the Al—Si alloy plating layer is limited to a predetermined film thickness (thickness) or less, it is possible to sufficiently suppress the amount of hydrogen intruding into the steel sheet for hot stamping even when hot stamping is carried out in an environment where the dew point is not controlled.

The present invention has been made by further progressing studies based on the above-described finding, and the gist thereof is as described below.

(1) A steel sheet for hot stamping according to one aspect of the present invention including:

a base material, an Al—Si alloy plating layer in which an Al content is 75 mass % or more, a Si content is 3 mass % or more and a total of the Al content and the Si content is 95 mass % or more, an Al oxide coating having a thickness of 0 to 20 nm, and a Ni plating layer having a Ni content of more than 90 mass % in this order, in which the base material has a chemical composition of, by mass %, C: 0.01% or more and less than 0.70%, Si: 0.001% to 1.000%, Mn: 0.40% to 3.00%, sol. Al: 0.0002% to 0.5000%, P: 0.100% or less, S: 0.1000% or less, N: 0.0100% or less, Cu: 0% to 1.00%, Ni: 0% to 1.00%, Nb: 0% to 0.150%, V: 0% to 1.000%, Ti: 0% to 0.150%, Mo: 0% to 1.000%, Cr: 0% to 1.000%, B: 0% to 0.0100%, Ca: 0% to 0.010%, REM: 0% to 0.300%, and a remainder: Fe and an impurity, the Al—Si alloy plating layer has a thickness of 7 to 148 μm, and the Ni plating layer has a thickness of more than 200 nm and 2500 nm or less.

(2) The steel sheet for hot stamping according to (1), in which the Ni plating layer may be provided in direct contact with the Al—Si alloy plating layer as an upper layer of the Al—Si alloy plating layer.

(3) The steel sheet for hot stamping according to (1), in which the Al oxide coating may have a thickness of 2 to 20 nm.

(4) The steel sheet for hot stamping according to any one of (1) to (3), in which the chemical composition of the base material may contain, by mass %, one or two or more selected from the group consisting of Cu: 0.005% to 1.000%, Ni: 0.005% to 1.000%, Nb: 0.010% to 0.150%, V: 0.005% to 1.000%, Ti: 0.010% to 0.150%, Mo: 0.005% to 1.000%, Cr: 0.050% to 1.000%, B: 0.0005% to 0.0100%, Ca: 0.001% to 0.010%, and REM: 0.001% to 0.300%.

(5) The steel sheet for hot stamping according to any one of (1) to (4), in which a dislocation density at a depth of 100 μm from a surface of the base material may be $5\times10^{13}$ m/m$^3$ or more.

Effects of the Invention

According to the above-described aspect of the present invention, it is possible to provide a steel sheet for hot stamping having excellent hydrogen embrittlement resistance by suppressing the intrusion of hydrogen into the steel sheet during hot stamping in a high-dew point environment even when the steel sheet for hot stamping has been provided with Al plating.

EMBODIMENT(S) FOR IMPLEMENTING THE INVENTION

<Steel Sheet for Hot Stamping>

As a result of intensive studies, the present inventors found that, when a steel sheet having Al plating formed thereon is hot-stamped in an environment where the dew point is not controlled, Al on the surface of the Al plating and water in the atmosphere react with each other, whereby a large amount of hydrogen is generated and a large amount of hydrogen intrudes into the steel sheet.

As a result of additional intensive studies, the present inventors obtained the following findings.

(A) When a Ni plating layer where the Ni content is more than 90 mass % is used, it is possible to suppress the intrusion of hydrogen into a steel sheet during hot stamping at a high dew point.

(B) When the layer thickness (thickness) of the Ni plating layer is more than 200 nm, the reaction with water in the atmosphere is sufficiently suppressed, and the amount of hydrogen intruding into the steel sheet can be reduced.

(C) When the film thickness (thickness) of an Al oxide coating on an Al—Si alloy plating layer is reduced, it is possible to reduce the area of a defect region in the Ni plating layer where no Ni plating layer is formed, and consequently, Al on the surface of the Al—Si alloy plating layer that comes into contact with the atmosphere can be reduced.

(D) In a case where a Ni plating layer is formed on an Al plating by electro plating or the like, the adhesion of the Ni plating layer is not sufficient as a steel sheet for hot stamping; however, when the thickness of the Al oxide coating is set to 0 to 20 nm, sufficient adhesion of the Ni plating layer can be obtained such that the steel sheet can be used as a steel sheet for hot stamping.

Figure 1:
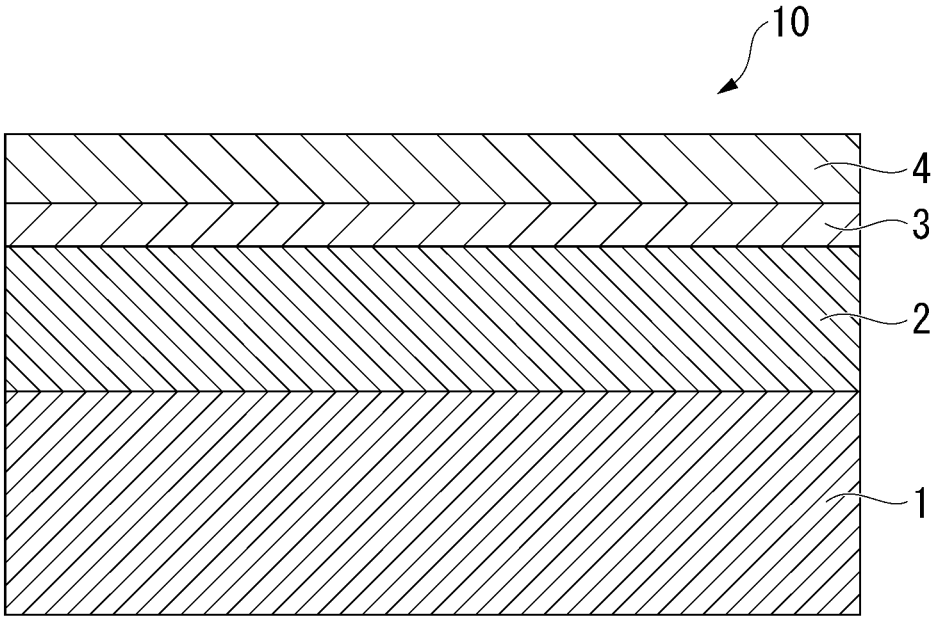
FIG. 1 is a schematic cross-sectional view of a steel sheet for hot stamping according to an embodiment of the present invention.
Figure 2:
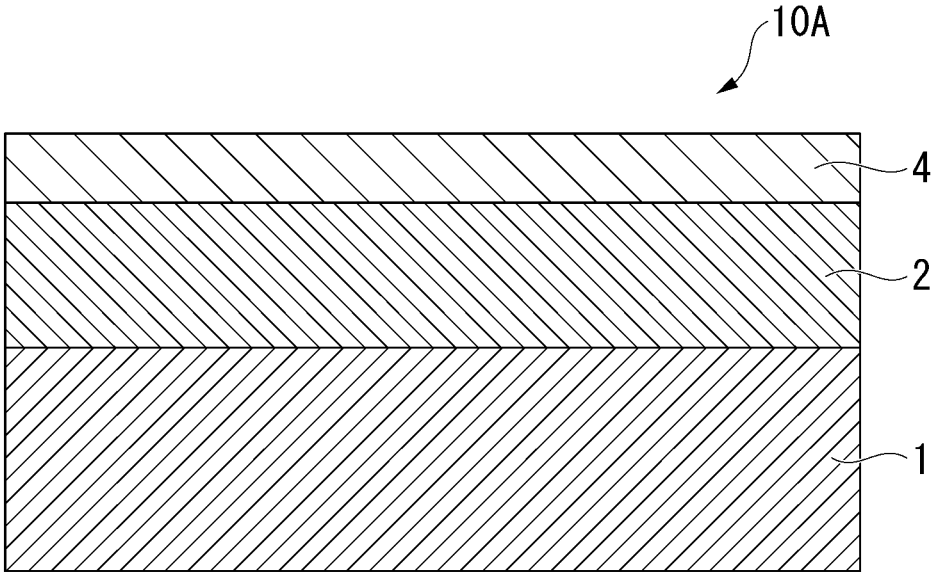
FIG. 2 is a schematic cross-sectional view of a steel sheet for hot stamping according to another embodiment of the present invention

In a steel sheet for hot stamping according to the present embodiment, the configuration of the steel sheet for hot stamping was determined based on the above-described findings. In the steel sheet for hot stamping according to the present embodiment, an intended effect of the present invention can be obtained due to the synergistic effects of individual plating configurations. As shown in FIG. 1, a steel sheet for hot stamping 10 includes a steel sheet (base material) 1, an Al—Si alloy plating layer 2, an Al oxide coating 3 and a Ni plating layer 4. In a case where there is no Al oxide coating 3, as shown in FIG. 2, a steel sheet for hot stamping 10A includes the base material 1, the Al—Si alloy plating layer 2 and the Ni plating layer 4. Hereinafter, each configuration will be described. In the present specification, numerical ranges expressed using "to" include numerical values before and after "to" as the lower limit value and the upper limit value. Numerical values expressed with "more than" and "less than" are not included in numerical ranges. Regarding chemical compositions, "%" indicates "mass %" in all cases.

(Steel Sheet)

A steel sheet (base material) that serves as the base material 1 of the steel sheet for hot stamping 10 according to the present embodiment contains, as a chemical composition, by mass %, C: 0.01% or more and less than 0.70%, Si: 0.001% to 1.000%, Mn: 0.40% to 3.00%, sol. Al: 0.0002% to 0.5000%, P: 0.100% or less, S: 0.1000% or less, N: 0.0100% or less and a remainder being Fe and an impurity.

"C: 0.01% or More and Less than 0.70%"

C is an important element for securing hardenability. When the C content of the base material is less than 0.01%, it becomes difficult to obtain sufficient hardenability, and the tensile strength decreases. Therefore, the C content of the base material is preferably set to 0.01% or more. In a case where the C content is 0.25% or more, a tensile strength of 1600 MPa or more can be obtained, which is preferable. The C content is more preferably 0.28% or more. On the other hand, when the C content is 0.70% or more, a coarse carbide is generated, breakage is likely to occur, and the hydrogen embrittlement resistance of a hot-stamping formed body deteriorates. Therefore, the C content is set to less than 0.70%. The C content is preferably 0.36% or less.

"Si: 0.001% to 1.000%"

Si is an element that is contained to secure hardenability. When the Si content is less than 0.001%, the above-described effect cannot be obtained. Therefore, the Si content is set to 0.001% or more. A more preferable Si content is 0.005% or more. A still more preferable Si content is 0.100% or more. In a case where Cu is contained, the Si content is preferably set to 0.350% or more in order to suppress the hot embrittlement of Cu. When more than 1.000% of Si is contained, the austenite transformation temperature ($Ac_3$ or the like) becomes extremely high, and there is a case where the cost necessary for heating for hot stamping increases or ferrite remains during the heating for hot stamping to decrease the tensile strength of a hot-stamping formed body. Therefore, the Si content is set to 1.000% or less. The Si content is preferably 0.8000% or less. In a case where Cu is contained, since the temperature of the austenite transformation temperature becomes high, the Si content is preferably 0.600% or less. The Si content may be 0.400% or less or 0.250% or less.

"Mn: 0.40% to 3.00%"

Mn is an element that contributes to improvement in the tensile strength of a hot-stamping formed body by solid solution strengthening. When the Mn content is less than 0.40%, there is a case where the hot-stamping formed body breaks due to hydrogen embrittlement. Therefore, the Mn content is set to 0.40% or more. The Mn content is preferably 0.80% or more. On the other hand, when the Mn content is set to more than 3.00%, a coarse inclusion is generated in steel, breakage is likely to occur, and additionally, the hydrogen embrittlement resistance deteriorates, and thus the Mn content is set to 3.00% or less. The Mn content is preferably 2.00% or less.

"Sol. Al: 0.0002% to 0.5000%"

Al is an element having an action of deoxidizing molten steel to improve the quality of the steel (suppressing the generation of a defect such as a blowhole in steel). When the sol. Al content is less than 0.0002%, deoxidation does not sufficiently occur, the above-described effect cannot be obtained, and additionally, there is a case where the hydrogen embrittlement of the hot-stamping formed body occurs. Therefore, the sol. Al content is set to 0.0002% or more. The sol. Al content is preferably 0.0010% or more or 0.0020% or more. On the other hand, when the sol. Al content exceeds 0.5000%, a coarse oxide is generated in steel, and there is a case where the hydrogen embrittlement of the hot-stamping formed body occurs. Therefore, the sol. Al content is set to 0.5000% or less. The sol. Al content is preferably 0.4000% or less or 0.3000% or less. sol. Al means acid-soluble Al and refers to the total amount of the solid solution of Al that is present in steel in a solid solution state and Al that is present in steel as an acid-soluble precipitate such as AlN.

"P: 0.100% or Less"

P is an element that is segregated in grain boundaries and degrades the strength of the grain boundaries. When the P content exceeds 0.100%, the strength of the grain boundaries significantly decreases, and there is a case where the hydrogen embrittlement of the hot-stamping formed body occurs. Therefore, the P content is set to 0.100% or less. The P content is preferably 0.050% or less. A more preferable P content is 0.010% or less. The lower limit of the P content is not particularly limited; however, when the lower limit is decreased to lower than 0.0005%, the dephosphorization cost increases significantly, which is not preferable economically, and thus the lower limit may be set to 0.0005% in actual operation.

"S: 0.1000% or Less"

S is an element that forms an inclusion in steel. When the S content exceeds 0.1000%, a large amount of an inclusion is generated in steel, the hydrogen embrittlement resistance of the hot-stamping formed body deteriorates, and there is a case where the hydrogen embrittlement of the hot-stamping formed body occurs. Therefore, the S content is set to 0.1000% or less. The S content is preferably 0.0050% or less. The lower limit of the S content is not particularly limited; however, when the lower limit is decreased to lower than 0.00015%, the desulfurization cost increases significantly, which is not preferable economically, and thus the lower limit may be set to 0.00015% in actual operation.

"N: 0.0100% or Less"

N is an impurity element and an element that forms a nitride in steel to degrade the toughness and hydrogen embrittlement resistance of the hot-stamping formed body. When the N content exceeds 0.0100%, a coarse nitride is generated in steel, and there is a case where the hydrogen embrittlement of the hot-stamping formed body occurs. Therefore, the N content is set to 0.0100% or less. The N content is preferably 0.0050% or less. The lower limit of the N content is not particularly limited; however, when the lower limit is decreased to lower than 0.0001%, the denitrification cost increases significantly, which is not preferable economically, and thus the lower limit may be set to 0.0001% in actual operation.

The steel sheet (base material) that configures the steel sheet for hot stamping 10 according to the present embodiment may contain, instead of some of Fe, one or two or more selected from the group consisting of Cu, Ni, Nb, V, Ti, Mo, Cr, B, Ca and REM as an arbitrary element. In a case where the following arbitrary element is not contained, the content thereof is 0%.

"Cu: 0% to 1.00%"

Cu has an action of diffusing up to a plating layer of a hot stamping member during hot stamping to reduce hydrogen that intrudes during heating in the manufacturing of the hot stamping member. Therefore, Cu may be contained as necessary. In addition, Cu is an effective element for enhancing the hardenability of steel to stably secure the tensile strength of the quenched hot-stamping formed body. In a case where Cu is contained, the Cu content is preferably set to 0.005% or more in order to reliably exhibit the above-described effect. The Cu content is more preferably 0.150% or more. On the other hand, even when more than 1.00% of Cu is contained, the above-described effect is saturated, and thus the Cu content is preferably set to 1.00% or less. The Cu content is more preferably 0.350% or less.

"Ni: 0% to 1.00%"

Ni is an important element to suppress hot embrittlement caused by Cu during the manufacturing of the steel sheet and secure stable production, and thus Ni may be contained. When the Ni content is less than 0.005%, there is a case where the above-described effects cannot be sufficiently obtained. Therefore, the Ni content is preferably 0.005% or more. The Ni content is preferably 0.05% or more. On the other hand, when the Ni content exceeds 1.00%, the limit hydrogen amount of the steel sheet for hot stamping decreases. Therefore, the Ni content is set to 1.00% or less. The Ni content is preferably 0.60% or less.

"Nb: 0% to 0.150%"

Nb is an element that contributes to improvement in the tensile strength of the hot-stamping formed body by solid solution strengthening and thus may be contained as necessary. In a case where Nb is contained, the Nb content is preferably set to 0.010% or more in order to reliably exhibit the above-described effect. The Nb content is more preferably 0.030% or more. On the other hand, even when more than 0.150% of Nb is contained, the above-described effect is saturated, and thus the Nb content is preferably set to 0.150% or less. The Nb content is more preferably 0.100% or less.

"V: 0% to 1.000%"

V is an element that forms a fine carbide and improves the limit hydrogen amount of steel by a refining effect or hydrogen trapping effect thereof. Therefore, V may be contained. In order to obtain the above-described effects, 0.005% or more of V is preferably contained, and 0.05% or more of V is more preferably contained. However, when the V content exceeds 1.000%, the above-described effects are saturated, and the economic efficiency decreases. Therefore, in the case of being contained, the V content is set to 1.000% or less.

"Ti: 0% to 0.150%"

Ti is an element that contributes to improvement in the tensile strength of the hot-stamping formed body by solid solution strengthening and thus may be contained as necessary. In a case where Ti is contained, the Ti content is preferably set to 0.010% or more in order to reliably exhibit the above-described effect. The Ti content is preferably 0.020% or more. On the other hand, even when more than 0.150% of Ti is contained, the above-described effect is saturated, and thus the Ti content is preferably set to 0.150% or less. The Ti content is more preferably 0.120% or less.

"Mo: 0% to 1.000%"

Mo is an element that contributes to improvement in the tensile strength of the hot-stamping formed body by solid solution strengthening and thus may be contained as necessary. In a case where Mo is contained, the Mo content is preferably set to 0.005% or more in order to reliably exhibit the above-described effect. The Mo content is more preferably 0.010% or more. On the other hand, even when more than 1.000% of Mo is contained, the above-described effect is saturated, and thus the Mo content is preferably set to 1.000% or less. The Mo content is more preferably 0.800% or less.

"Cr: 0% to 1.000%"

Cr is an element that contributes to improvement in the tensile strength of the hot-stamping formed body by solid solution strengthening and thus may be contained as necessary. In a case where Cr is contained, the Cr content is preferably set to 0.050% or more in order to reliably exhibit the above-described effect. The Cr content is more preferably 0.100% or more. On the other hand, even when more than 1.000% of Cr is contained, the above-described effect is saturated, and thus the Cr content is preferably set to 1.000% or less. The Cr content is more preferably 0.800% or less.

"B: 0% to 0.0100%"

B is an element that is segregated in grain boundaries to improve the strength of the grain boundaries and thus may be contained as necessary. In a case where B is contained, the B content is preferably set to 0.0005% or more in order to reliably exhibit the above-described effect. The B content is preferably 0.0010% or more. On the other hand, even when more than 0.0100% of B is contained, the above-described effect is saturated, and thus the B content is preferably set to 0.0100% or less. The B content is more preferably 0.0075% or less.

"Ca: 0% to 0.010%"

Ca is an element having an action of deoxidizing molten steel to improve the quality of the steel. In order to reliably exhibit this action, the Ca content is preferably set to 0.001% or more. On the other hand, even when more than 0.010% of Ca is contained, the above-described effect is saturated, and thus the Ca content is preferably set to 0.010% or less.

"REM: 0% to 0.300%"

REM is an element having an action of deoxidizing molten steel to improve the quality of the steel. In order to reliably exhibit this action, the REM content is preferably set to 0.001% or more. On the other hand, even when more than 0.300% of REM is contained, the above-described effect is saturated, and thus the REM content is preferably set to 0.300% or less.

In the present embodiment, REM refers to a total of 17 elements consisting of Sc, Y, and lanthanoids, and the REM content refers to the total amount of these elements.

"Remainder being Fe and Impurity"

The remainder of the chemical composition of the base material 1 that configures the steel sheet for hot stamping 10 according to the present embodiment is Fe and an impurity. As the impurity, exemplified is an element that is inevitably incorporated from a steel raw material or a scrap and/or in a steelmaking process or intentionally added and is permitted to an extent that the properties of hot-stamping formed bodies, which are the steel sheet for hot stamping 10 according to the present embodiment that have been hot-stamped, are not impaired.

The above-described chemical composition of the base material 1 may be measured by an ordinary analytical method. For example, the chemical composition may be measured using inductively coupled plasma-atomic emission spectrometry (ICP-AES). C and S may be measured using an infrared absorption method after combustion, and N may be measured using an inert gas melting-thermal conductivity method. The chemical composition needs to be analyzed after the plating layer on the surface is removed by machining. sol. Al may be measured by ICP-AES using a filtrate obtained by hydrolyzing a specimen with an acid.

"Metallographic Structure"

Next, the metallographic structure of the base material 1 that configures the steel sheet for hot stamping 10 according to the present embodiment will be described. In the metallographic structure of the base material 1 of the steel sheet for hot stamping 10, the area ratio of ferrite is preferably 20% or more in terms of the area ratio in a cross section. A more preferable area ratio of ferrite is 30% or more. The area ratio of ferrite is preferably 80% or less. A more preferable area ratio of ferrite is 70% or less. The area ratio of pearlite is preferably 20% or more in terms of the area ratio in a cross section. The area fraction of pearlite is preferably 80% or less. A more preferable area ratio of pearlite is 70% or less. The remainder may be bainite, martensite or residual austenite. The area ratio of the remainder in microstructure may be less than 5%.

(Measurement Method of Area Ratios of Ferrite and Pearlite)

The area ratios of ferrite and pearlite are measured by the following method. A cross section parallel to a rolling direction at the central position in the sheet width direction is finished into a mirror-like surface and polished for eight minutes using colloidal silica containing no alkaline solution at room temperature to remove strain introduced into the surface layer of a sample. At an arbitrary position in the longitudinal direction of the sample cross section, a region from a ⅛ depth of the sheet thickness from the surface to a ⅜ depth of the sheet thickness from the surface, which is 50 μm in length, is measured at measurement intervals of 0.1 μm by an electron backscatter diffraction method such that a ¼ depth of the sheet thickness from the surface can be analyzed to obtain crystal orientation information. For the measurement, an instrument composed of a thermal field emission-type scanning electron microscope (JSM 7001F manufactured by JEOL Ltd.) and an EBSP detector (DVC 5-type detector manufactured by TSL) is used. In this case, the degree of vacuum in the instrument is set to $9.6\times10^{-5}$ Pa or less, the accelerating voltage is set to 15 kV, the irradiation current level is set to 13, and the irradiation level of an electron beam is set to 62. Furthermore, a reflected electron image is captured at the same visual field.

First, crystal grains where ferrite and cementite are precipitated in layers are specified from the reflected electron image, and the area ratio of the crystal grains is calculated, thereby obtaining the area ratio of pearlite. After that, for crystal grains except the crystal grains determined as pearlite, from the obtained crystal orientation information, regions where the grain average misorientation value is 1.0° or less are determined as ferrite using a "Grain Average Misorientation" function mounted in software "OIM Analysis (registered trademark)" included in the EBSP analyzer. The area ratio of the regions determined as ferrite is obtained, thereby obtaining the area ratio of ferrite.

(Determination Method of Area Ratio of Remainder in Microstructure)

The area ratio of the remainder in the present embodiment is a value obtained by subtracting the area ratios of ferrite and pearlite from 100%.

"Dislocation density at depth of 100 μm from surface being $5\times10^{13}$ m/m$^3$ or more"

The dislocation density of the base material 1 that configures the steel sheet for hot stamping 10 according to the present embodiment will be described. The dislocation density at a depth of 100 μm from the surface of the base material 1 that configures the steel sheet for hot stamping 10 according to the present embodiment is preferably $5\times10^{13}$ m/m$^3$ or more. A more preferable dislocation density is $50\times10^{13}$ m/m$^3$ or more. When the dislocation density at 100 μm from the surface of the base material 1 is $5\times10^{13}$ m/m$^3$ or more, it becomes easy for Al in the Al—Si alloy plating layer 2 to migrate toward the base material 1. Therefore, it is possible to suppress Al in the Al—Si alloy plating layer 2 migrating up to the outermost surface of the Ni plating layer 4 of the steel sheet for hot stamping 10 by heating during hot stamping. The dislocation density is preferably $1000\times10^{13}$ m/m$^3$ or less. A more preferable dislocation density is $150\times10^{13}$ m/m$^3$ or less.

"Measurement of Dislocation Density"

Next, a measurement method of the dislocation density at a depth of 100 μm from the surface of the base material 1 will be described. The dislocation density can be measured by the X-ray diffraction method or transmission electron microscopic observation, but is measured using the X-ray diffraction method in the present embodiment.

First, a sample is cut out from an arbitrary position 50 mm or more apart from an end face of the base material 1 that is used in the steel sheet for hot stamping 10. While also depending on a measuring instrument, the size of the sample is set to a size of approximately 20 mm×20 mm. The thickness of the sample is reduced by 200 μm using a solution mixture of 48 mass % of diluted water, 48 mass % of hydrogen peroxide water and 4 mass % of hydrofluoric acid. At this time, the front surface and the rear surface of the sample are each reduced by 100 μm, and 100 μm regions are exposed from the surfaces of the sample to be depressurized. X-ray diffraction measurement is carried out on these exposed surfaces, and a plurality of diffraction peaks of body-centered cubic lattices is specified. The dislocation densities are analyzed from the half-value widths of these diffraction peaks, thereby obtaining the dislocation density at a depth of 100 μm from the surface. As an analysis method, a modified Williamson-Hall method described in Non-Patent Document 1 is used. In the case of measuring the dislocation density of the steel sheet for hot stamping 10 including the Al—Si alloy plating layer 2 and the Ni plating layer 4, the dislocation density is measured after the Al—Si alloy plating layer 2 and the Ni plating layer 4 are removed. As a method for removing the Al—Si alloy plating layer 2 and the Ni plating layer 4, for example, a method in which the steel sheet for hot stamping 10 is immersed in a NaOH aqueous solution is an exemplary example.

The sheet thickness of the base material 1 of the steel sheet for hot stamping 10 according to the present embodiment is not particularly limited, but is preferably 0.4 mm or more from the viewpoint of the weight reduction of vehicle bodies. A more preferable sheet thickness of the base material 1 is 0.8 mm or more, 1.0 mm or more or 1.2 mm or more. The sheet thickness of the base material 1 is preferably set to 6.0 mm or less. A more preferable sheet thickness of the base material 1 is 5.0 mm or less, 4.0 mm or less, 3.2 mm or less or 2.8 mm or less.

(Al—Si Alloy Plating Layer)

The Al—Si alloy plating layer 2 of the steel sheet for hot stamping 10 according to the present embodiment is provided as an upper layer of the base material 1. The Al—Si alloy plating layer 2 is plating containing Al and Si as main components. Here, the expression "containing Al and Si as main component" means that at least the Al content is 75 mass % or more, the Si content is 3 mass % or more and the total of the Al content and the Si content is 95 mass % or more. The Al content in the Al—Si alloy plating layer 2 is preferably 80 mass % or more. The Al content in the Al—Si alloy plating layer is preferably 95 mass % or less. When the Al content in the Al—Si alloy plating layer 2 is in this range, scale having favorable adhesion is formed on the surface of the steel sheet during hot stamping.

The Si content in the Al—Si alloy plating layer 2 is preferably 3 mass % or more. The Si content in the Al—Si alloy plating layer 2 is more preferably 6 mass % or more. The Si content in the Al—Si alloy plating layer 2 is preferably 20 mass % or less. The Si content is more preferably 12 mass % or less. When the Si content in the Al—Si alloy plating layer 2 is 3 mass % or more, alloying of Fe and Al can be suppressed. In addition, when the Si content in the Al—Si alloy plating layer 2 is 20 mass % or less, it is possible to suppress an increase in the melting point of the Al—Si alloy plating layer 2 and to decrease the temperature of a hot-dip plating bath. Therefore, when the Si content in the Al—Si alloy plating layer 2 is 20 mass % or less, it is possible to reduce the production cost. The total of the Al content and the Si content may be 97 mass % or more, 98 mass % or more or 99 mass % or more. The remainder in the Al—Si alloy plating layer 2 is Fe and an impurity. As the impurity, a component that is inevitably incorporated during the manufacturing of the Al—Si alloy plating layer 2, a component in the base material 1 or the like is an exemplary example.

The average layer thickness (thickness) of the Al—Si alloy plating layer 2 of the steel sheet for hot stamping 10 according to the present embodiment is 7 μm or more. This is because, when the thickness of the Al—Si alloy plating layer 2 is less than 7 μm, there is a case where it is not possible to form scale having favorable adhesion during hot stamping. A more preferable thickness of the Al—Si alloy plating layer 2 is 12 μm or more, 15 mm or more, 18 μm or more or 22 mm or more. The thickness of the Al—Si alloy plating layer 2 is 148 μm or less. This is because, when the thickness of the Al—Si alloy plating layer 2 is more than 148 μm, not only is the above-described effect saturated, but the cost also increases. A more preferable thickness of the Al—Si alloy plating layer 2 is 100 μm or less, 60 μm or less, 45 μm or less or 37 μm or less.

The thickness of the Al—Si alloy plating layer 2 is measured as described below. The steel sheet for hot stamping 10 is cut in the sheet thickness direction, and then the cross section of the steel sheet for hot stamping 10 is polished. On the polished cross section of the steel sheet for hot stamping 10, a region from the surface of the steel sheet for hot stamping 10 to the base material 1 is linearly analyzed by a ZAF method with an electron probe microanalyzer (FE-EPMA), and, among detected components, the Al concentration (content) and the Si concentration (content) are measured. As the measurement conditions, the accelerating voltage needs to set to 15 kV, the beam diameter needs to be set to approximately 100 nm, the irradiation time per point needs to be set to 1000 ms, and the measurement pitches need to be set to 60 nm. A region where the Al content is 75 mass % or more, the Si content is 3 mass % or more and the total of the Al content and the Si content is 95 mass % or more is determined as the Al—Si alloy plating layer 2. The thickness of the Al—Si alloy plating layer 2 is the length of the above-described region in the sheet thickness direction. The thicknesses of layer of the Al—Si alloy plating layer 2 are measured at five positions at 5 μm intervals, and the arithmetic average of the obtained values is regarded as the thickness of the Al—Si alloy plating layer 2.

Regarding the Al content and the Si content in the Al—Si alloy plating layer 2, according to a testing method described in JIS K 0150 (2005), a test piece is collected, the Al content and the Si content are measured at a ½ position of the thickness of the Al—Si alloy plating layer 2, whereby the Al content and the Si content in the Al—Si alloy plating layer 2 in the steel sheet for hot stamping 10 can be obtained.

(Al Oxide Coating)

The Al oxide coating 3 of the steel sheet for hot stamping 10 according to the present embodiment is provided in contact with the Al—Si alloy plating layer 2 as an upper layer of the Al—Si alloy plating layer 2. The Al oxide coating is defined as a region where the O content is 20 atomic % or more.

In a case where the thickness of the Al oxide coating 3 of the steel sheet for hot stamping 10 according to the present embodiment is more than 20 nm, there is a possibility that the adhesion to the Ni plating layer 4 that is provided over the Al—Si alloy plating layer 2 may deteriorate and upper layer plating may exfoliate during handling such as hot stamping forming. This plating peeling does not create any problems in carrying out hot stamping, but degrades the hydrogen embrittlement resistance. In addition, in a case where the thickness of the Al oxide coating 3 is more than 20 nm, the coverage of the Ni plating layer 4 that is provided as an upper layer of the Al oxide coating 3 becomes less than 90%. Therefore, the thickness of the Al oxide coating 3 is 0 to 20 nm or less. The thickness of the Al oxide coating 3 is more preferably 10 nm or less. The thickness of the Al oxide coating 3 may be 2 nm or more. Since the Al oxide coating 3 may not be provided, the lower limit of the Al oxide coating 3 is 0 nm. In that case, the Ni plating layer 4 is formed so as to come into contact with the Al—Si alloy plating layer 2.

The thickness of the Al oxide coating 3 is evaluated by alternately repeating Ar sputtering and X-ray photoelectron spectroscopy (XPS) measurement. Specifically, the steel sheet for hot stamping 10 is sputtered by Ar sputtering (accelerating voltage: 20 kV, sputtering rate: 1.0 nm/min), and then XPS measurement is carried out. The Ar sputtering and the XPS measurement are alternately carried out, and these measurements are repeated until a peak with a bonding energy of the 2p orbit of Al oxidized in the XPS measurement of 73.8 eV to 74.5 eV appears and then disappears. The thickness of the Al oxide coating 3 is calculated from the sputtering time and the sputtering rate from a position where the O content reaches 20 atomic % or more for the first time after the start of the sputtering to a position where the O content reaches less than 20 atomic %. The sputtering rate is obtained in terms of $SiO_2$. The thickness of the Al oxide coating 3 is the arithmetic average value of two measurement sites.

(Ni Plating Layer)

The Ni plating layer 4 of the steel sheet for hot stamping 10 according to the present embodiment is provided in contact with the Al oxide coating 3 as an upper layer of the Al oxide coating 3. In a case where the Al oxide coating 3 is not provided, the Ni plating layer 4 is provided in contact with the Al—Si alloy plating layer 2 as an upper layer of the Al—Si alloy plating layer 2. Ni is not easily oxidized and does not easily generate hydrogen due to the suppression of oxidation by water at a high temperature. Furthermore, even when hydrogen is generated and adsorbed to the surface, a Tafel reaction where hydrogen atoms bond to each other, become hydrogen gas, and are desorbed is accelerated, and thus Ni has an effect on suppressing the intrusion of hydrogen into the steel sheet. Therefore, when the Ni plating layer 4 is formed, it is possible to suppress the amount of hydrogen intruding into the steel sheet for hot stamping 10 during hot stamping.

The average layer thickness (thickness) of the Ni plating layer 4 according to the present embodiment is more than 200 nm. A more preferable thickness of the Ni plating layer 4 is 280 nm or more, 350 nm or more, 450 mu or more, 560 nm or more or 650 nm or more. When the thickness of the Ni plating layer 4 is 200 nm or less, it is not possible to sufficiently suppress the intrusion of hydrogen into the base material 1 during hot stamping. In addition, the thickness of the Ni plating layer 4 is 2500 nm or less. A more preferable thickness of the Ni plating layer 4 is 1500 nm or less, 1200 nm or less or 1000 nm or less. When the thickness of the Ni plating layer 4 is more than 2500 nm, the effect on suppressing the amount of hydrogen intruding into the base material 1 is saturated, and the cost increases.

When the Ni content in the Ni plating layer 4 is 90 mass % or less, there is a case where the effect on suppressing the amount of hydrogen intruding into the steel sheet for hot stamping 10 cannot be obtained. Therefore, the Ni content in the Ni plating layer 4 is more than 90 mass %. A more preferable Ni content is 92 mass % or more. A more preferable Ni content is 93 mass % or more or 94 mass %. A still more preferable Ni content is 96 mass % or more, 98 mass % or more or 99 mass % or more. The chemical composition of the remainder of the Ni plating layer (excluding Ni) is not particularly limited. Cr may be contained in the Ni plating layer, and the Ni/Cr ratio is preferably larger than 9, and this ratio is more preferably 15 or more or 30 or more. More preferably, the Cr content in the Ni plating layer is preferably 6.0 mass % or less and more preferably 4.0 mass % or less or 3.0 mass % or less. The Cr content in the Ni plating layer 3 is still more preferably 2.0 mass % or less. When the Cr content is reduced, it is possible to reduce the amount of hydrogen intruding into the steel sheet.

The coverage of the Ni plating layer 4 on the Al oxide coating 3 (in a case where the Al oxide coating 3 is not provided, the coverage of the Ni plating layer 4 on the Al—Si alloy plating layer 2) is preferably 90% or more. The coverage of the Ni plating layer 4 is more preferably 95% or more. When the coverage of the Ni plating layer 4 is less than 90%, it is not possible to sufficiently suppress a reaction between water vapor and Al on the surface of the Al—Si plating layer 2 during hot stamping. The coverage of the Ni plating layer 4 may be 100% or less or may be 99% or less.

The coverage of the Ni plating layer is evaluated by XPS measurement. Specifically, the XPS measurement is carried out by scanning the steel sheet for hot stamping 10 in the entire energy range using Quantum 2000 manufactured by ULVAC-PHI, Inc. and Al Kα rays as a radiation source under conditions of an output of 15 kV, 25 W, a spot size of 100 μm and the number of times of scanning of 10 times, analysis is carried out using analysis software MultiPak V. 8.0 manufactured by ULVAC-PHI, Inc., and the Ni content (atomic %), the Al content (atomic %) and the amounts of other components (atomic %) in the detected metal components are obtained. The obtained content (atomic %) is converted to the content (mass %), whereby the Ni content (mass %) and the Al content (mass %) can be obtained. Next, the proportion (%) of the Ni content in the total of the Ni content and the Al content is calculated. The obtained proportion is regarded as the coverage (%) of the Ni plating.

The thickness of the Ni plating layer 4 is measured by alternately repeating Ar sputtering etching and X-ray photoelectron spectroscopy (XPS) measurement. Specifically, the steel sheet for hot stamping 10 is sputtering-etched by Ar sputtering (accelerating voltage: 20 kV, sputtering rate: 1.0 nm/min), and then XPS measurement is carried out. The Ar sputtering etching and the XPS measurement are alternately carried out, and these measurements are repeated until a peak with a bonding energy of the 2p orbit of Ni in the XPS measurement of 852.5 eV to 852.9 eV appears and then disappears. The layer thickness of the Ni plating layer 4 is calculated from the sputtering etching time and the sputtering etching rate while the peak in the above-described range from a position where the Ni content reaches 10 atomic % or more for the first time after the start of the sputtering to a position where the Ni content reaches less than 10 atomic % appears and then disappears. The sputtering etching rate is obtained in terms of $SiO_2$. The thickness of the Ni plating layer 4 is the arithmetic average value of two measurement sites.

Regarding the Ni content in the Ni plating layer 4, the Ni concentration at the central position in the sheet thickness direction of the Ni plating layer 4 that is obtained in the measurement of the thickness of the Ni plating layer is regarded as the Ni content.

(Thickness)

The thickness of the steel sheet for hot stamping 10 is not particularly limited and may be, for example, 0.4 mm or more. A more preferable thickness of the steel sheet is 0.8 mm or more, 1.0 mm or more or 1.2 mm or more. The thickness of steel for hot stamping may be 6.0 mm or less. A more preferable thickness of the steel sheet is 5.0 mm or less, 4.0 mm or less, 3.2 mm or less or 2.8 mm or less.

<Manufacturing Method of Steel Sheet for Hot Stamping>

Next, a preferable manufacturing method of the steel sheet for hot stamping 10 will be described. A slab that is to be subjected to hot rolling may be a slab manufactured by a normal method and may be, for example, a slab manufactured by an ordinary method such as a continuous cast slab or a thin slab caster. Hot rolling may also be carried out by an ordinary method and is not particularly limited.

"Cooling Start Temperature"

The start temperature of cooling after hot rolling (cooling start temperature) is preferably the $Ac_3$ point to 1400° C. When cooling starts in this range, it is possible to obtain a dislocation density of $5\times10^{13}$ m/m$^3$ or more at a depth of 100 μm from the surface of the base material 1 of the steel sheet for hot stamping 10. A more preferable cooling start temperature is 1000° C. to 1150° C. The $Ac_3$ point (° C.) is represented by the following formula (1).

$$Ac_3=912-230.5\times C+31.6\times Si-20.4\times Mn-14.8\times Cr-18.1\times Ni+16.8\times Mo-39.8\times Cu \quad (1)$$

Element symbols in the formula indicate the amounts by mass % of the corresponding elements, and zero is assigned in a case where an element is not contained.

"Cooling Rate"

The average cooling rate in the cooling after hot rolling is preferably 30° C./second or faster. A more preferable average cooling rate is 50° C./second or faster. When the average cooling rate is slower than 30° C./second, there is a case where it is not possible to obtain a dislocation density of $5\times10^{13}$ m/m$^3$ or more at a depth of 100 μm from the surface of the base material 1 of the steel sheet for hot stamping. The average cooling rate is preferably set to 200° C./second or slower. A more preferable average cooling rate is 100° C./second or slower. When the average cooling rate becomes faster than 200° C./second, the dislocation density becomes excessively high. The average cooling rate at this time is calculated from a change in the temperature of the surface of the steel sheet and indicates an average cooling rate from the end of the hot rolling to the start of coiling.

After the start of the cooling, the steel sheet is cooled to a temperature range of 400° C. to 600° C. and coiled. When the coiling start temperature is lower than 400° C., the dislocation density at a depth of 100 μm from the surface of the base material 1 of the steel sheet for hot stamping 10 becomes excessively high, which is not preferable. When the coiling start temperature is higher than 600° C., it is not possible to obtain a dislocation density of $5\times10^{13}$ m/m$^3$ or more.

After the coiling, cold rolling may be further carried out as necessary. The cumulative rolling reduction in the cold rolling is not particularly limited, but is preferably set to 40% to 60% from the viewpoint of the shape stability of the steel sheet.

"Al—Si Alloy Plating"

Al—Si alloy plating is provided on the hot-rolled steel sheet as it is or after cold rolling. A method for forming the Al—Si alloy plating layer 2 is not particularly limited, and a hot-dip plating method, an electro plating method, a vacuum deposition method, a cladding method, a thermal spraying method or the like can be used. The hot-dip plating method is particularly preferable.

In a case where the Al—Si alloy plating layer 2 is formed by the hot-dip plating method, the base material 1 is immersed in a plating bath where the components have been adjusted such that at least the Si content reaches 3 mass % or more and the total of the Al content and the Si content reaches 95 mass % or more, thereby obtaining the Al—Si alloy-plated steel sheet. The temperature of the plating bath is preferably within a temperature range of 660° C. to 690° C. Before the Al—Si alloy plating layer 2 is provided, plating may be carried out after the hot-rolled steel sheet is heated up to near the plating bath temperature of 650° C. to 780° C.

In addition, in a case where hot-dip plating is carried out, there is a case where Fe is incorporated into the plating bath as an impurity other than Al or Si. In addition, Ni, Mg, Ti, Zn, Sb, Sn, Cu, Co, In, Bi, Ca, mischmetal, and the like may be further contained in the plating bath as long as the Si content reaches 3 mass % or more and the total of the Al content and the Si content reaches 95 mass % or more.

"Removal of Al Oxide Coating"

Next, the Al oxide coating 3 is removed from the steel sheet on which the Al—Si alloy plating layer 2 has been formed (hereinafter, Al-plated steel sheet) to obtain an Al oxide coating-removed steel sheet. The Al oxide coating 3 is removed by immersing the Al-plated steel sheet in an acidic or basic removal solution. As the acidic removal solution, dilute hydrochloric acid (HCl 0.1 mol/L) or the like is an exemplary example. As the basic removal solution, a sodium hydroxide aqueous solution (NaOH 0.1 mol/L) or the like is an exemplary example. The immersion time is adjusted such that the thickness of the Al oxide coating 3 after the formation of the Ni plating layer 4 reaches 20 nm or less. For example, in a case where the bath temperature is 40° C., the Al oxide coating 3 is removed by immersing the Al-plated steel sheet for one minute.

"Ni Plating"

It is preferable that, after the Al oxide coating 3 is removed such that the thickness of the Al oxide coating 3 reaches 20 nm or less, Ni plating is provided on the Al oxide coating-removed steel sheet within one minute to form the Ni plating layer 4, thereby obtaining the steel sheet for hot stamping. The Ni plating layer 4 may be formed by an electro plating method, a vacuum deposition method or the like.

In a case where the Ni plating layer 4 is formed by electro plating, the steel sheet from which the Al oxide coating 3 has been removed is immersed in a plating bath containing nickel sulfate, nickel chloride and boric acid and the current density and the energization time are controlled as appropriate using soluble Ni as an anode, whereby the Ni plating layer 4 can be formed such that the thickness reaches more than 200 nm and 2500 nm or less.

After the Ni plating, temper rolling may be carried out at a cumulative rolling reduction of approximately 0.5% to 2% (particularly, in a case where the plating original sheet is a cold-rolled steel sheet).

<Hot Stamping Step>

Conditions for hot stamping where the steel sheet for hot stamping 10 according to the present embodiment is used will be described as an example, but the hot stamping conditions for the steel sheet for hot stamping 10 according to the present embodiment are not limited to these conditions.

The steel sheet for hot stamping 10 is put into a heating furnace and heated up to a temperature of the $Ac_3$ point or higher (target temperature) at a heating speed of 2.0° C./second to 10.0° C./second. After the target temperature is reached, the steel sheet for hot stamping 10 is held for approximately five seconds to 300 seconds, hot-stamped and cooled to room temperature. Therefore, a hot-stamping formed body is obtained.

(Tensile Strength of Hot-Stamping Formed Body)

The tensile strength of the hot-stamping formed body may be set to 1600 MPa or more. As necessary, the lower limit of the tensile strength may be set to 1650 MPa, 1700 MPa, 1750 MPa or 1800 MPa, and the upper limit may be set to 2500 MPa, 2400 MPa, 2300 MPa or 2220 MPa. The tensile strength of the hot-stamping formed body can be measured by the testing method described in JIS Z 2241: 2011 after a No. 5 test piece described in JIS Z 2241: 2011 was produced from an arbitrary position in the hot-stamping formed body.

EXAMPLES

Next, examples of the present invention will be described. Conditions in the examples are examples of conditions adopted to confirm the feasibility and effect of the present invention, and the present invention is not limited to the examples of conditions. The present invention is capable of adopting a variety of conditions as long as the objective of the present invention is achieved without departing from the gist of the present invention.

(Manufacturing of Steel Sheet)

Slabs manufactured by casting molten steel having a chemical composition shown in Tables 1-1 and 1-2 were hot-rolled by being heated up to a temperature of the $Ac_3$ to 1400° C., cooled under cooling conditions shown in Tables 2-1 and 2-2 and coiled at coiling start temperature shown in Tables 2-1 and 2-2, thereby obtaining hot-rolled steel sheets (steel sheets). In Test Nos. 73 to 82, the slabs were cold-rolled to a thickness of 1.6 mm from 3.2 mm after the hot rolling, thereby obtaining cold-rolled steel sheets. The other steel sheets were rolled to a thickness of 1.6 mm by hot rolling.

TABLE 1-1

| Steel | Chemical composition (mass %), remainder: Fe and impurity | | | | | | | | | | | | | | | | | Ac3 point | |
|---|---|---|---|---|---|---|---|---|---|---|---|---|---|---|---|---|---|---|---|
| No. | C | Si | Mn | P | s | sol. Al | N | Cu | Ni | Nb | V | Ti | Mo | Cr | B | Ca | REM | (° C.) | Note |
| 1 | 0.23 | 0.254 | 1.21 | 0.010 | 0.0009 | 0.0320 | 0.0039 | | | 0.012 | | 0.026 | 0.005 | 0.211 | 0.002 | | | 839 | Present Invention Steel |
| 2 | 0.24 | 0.197 | 1.18 | 0.007 | 0.0006 | 0.0128 | 0.0026 | | | | | | | | | | | 839 | Present Invention Steel |
| 3 | 0.25 | 0.194 | 1.27 | 0.006 | 0.0044 | 0.0389 | 0.0034 | | | | | | | | | | | 835 | Present Invention Steel |
| 4 | 0.31 | 0.197 | 1.67 | 0.007 | 0.0041 | 0.0381 | 0.0025 | | | | | | | | | | | 813 | Present Invention Steel |
| 5 | 0.35 | 0.198 | 1.42 | 0.007 | 0.0004 | 0.0247 | 0.0045 | | | | | | | | | | | 809 | Present Invention Steel |
| 6 | 0.45 | 0.216 | 1.73 | 0.008 | 0.0030 | 0.0333 | 0.0025 | | | | | | | | | | | 780 | Present Invention Steel |
| 7 | 0.65 | 0.230 | 1.32 | 0.009 | 0.0034 | 0.0183 | 0.0022 | | | | | | | | | | | 743 | Present Invention Steel |
| 8 | 0.72 | 0.222 | 1.89 | 0.009 | 0.0031 | 0.0268 | 0.0031 | | | | | | | | | | | 714 | Comparative Steel |
| 9 | 0.32 | 0.002 | 1.82 | 0.010 | 0.0038 | 0.0415 | 0.0035 | | | | | | | | | | | 801 | Present Invention Steel |
| 10 | 0.29 | 0.176 | 1.67 | 0.006 | 0.0030 | 0.0495 | 0.0032 | | | | | | | | | | | 817 | Present Invention Steel |
| 11 | 0.31 | 0.130 | 1.98 | 0.006 | 0.0022 | 0.0280 | 0.0032 | | | | | | | | | | | 804 | Present Invention Steel |
| 12 | 0.36 | 0.189 | 1.88 | 0.008 | 0.0016 | 0.0462 | 0.0024 | | | | | | | | | | | 797 | Present Invention Steel |
| 13 | 0.35 | 0.195 | 0.16 | 0.007 | 0.0045 | 0.0484 | 0.0017 | | | | | | | | | | | 834 | Comparative Steel |
| 14 | 0.45 | 0.201 | 0.42 | 0.005 | 0.0041 | 0.0109 | 0.0037 | | | | | | | | | | | 806 | Present Invention Steel |
| 15 | 0.36 | 0.223 | 0.78 | 0.010 | 0.0007 | 0.0287 | 0.0044 | | | | | | | | | | | 820 | Present Invention Steel |
| 16 | 0.32 | 0.190 | 1.31 | 0.006 | 0.0022 | 0.0441 | 0.0050 | | | | | | | | | | | 818 | Present Invention Steel |
| 17 | 0.30 | 0.216 | 1.76 | 0.010 | 0.0012 | 0.0261 | 0.0015 | | | | | | | | | | | 814 | Present Invention Steel |
| 18 | 0.35 | 0.191 | 2.41 | 0.006 | 0.0048 | 0.0251 | 0.0040 | | | | | | | | | | | 788 | Present Invention Steel |
| 19 | 0.28 | 0.201 | 2.88 | 0.007 | 0.0025 | 0.0360 | 0.0038 | | | | | | | | | | | 795 | Present Invention Steel |
| 20 | 0.29 | 0.212 | 0.90 | 0.005 | 0.0040 | 0.0486 | 0.0043 | | | | | | | | | | | 833 | Present Invention Steel |
| 21 | 0.30 | 0.218 | 1.65 | 0.095 | 0.0009 | 0.0111 | 0.0047 | | | | | | | | | | | 816 | Present Invention Steel |
| 22 | 0.30 | 0.219 | 1.06 | 0.113 | 0.0001 | 0.0224 | 0.0028 | | | | | | | | | | | 828 | Comparative Steel |
| 23 | 0.31 | 0.199 | 1.89 | 0.005 | 0.0003 | 0.0333 | 0.0019 | | | | | | | | | | | 808 | Present Invention Steel |
| 24 | 0.35 | 0.229 | 1.13 | 0.005 | 0.0036 | 0.0188 | 0.0027 | | | | | | | | | | | 816 | Present Invention Steel |
| 25 | 0.35 | 0.220 | 1.51 | 0.009 | 0.0946 | 0.0146 | 0.0043 | | | | | | | | | | | 807 | Present Invention Steel |

TABLE 1-1-continued

| Steel | Chemical composition (mass %), remainder: Fe and impurity | | | | | | | | | | | | | | | | | Ac3 point | |
|---|---|---|---|---|---|---|---|---|---|---|---|---|---|---|---|---|---|---|---|
| No. | C | Si | Mn | P | s | sol. Al | N | Cu | Ni | Nb | V | Ti | Mo | Cr | B | Ca | REM | (° C.) | Note |
| 26 | 0.30 | 0.229 | 1.46 | 0.009 | 0.1122 | 0.0148 | 0.0025 | | | | | | | | | | | 820 | Comparative Steel |

Underlines indicate that the corresponding values are outside the scope of the present invention.

TABLE 1-2

| Steel | Chemical composition (mass %), remainder: Fe and impurity | | | | | | | | | | | | | | | | |
|---|---|---|---|---|---|---|---|---|---|---|---|---|---|---|---|---|---|
| No. | C | Si | Mn | P | S | sol. Al | N | Cu | Ni | Nb | V | Ti | Mo | Cr | B | Ca | REM |
| 27 | 0.36 | 0.222 | 1.97 | 0.005 | 0.0019 | 0.0001 | 0.0032 | | | | | | | | | | |
| 28 | 0.28 | 0.216 | 1.14 | 0.005 | 0.0008 | 0.0003 | 0.0031 | | | | | | | | | | |
| 29 | 0.30 | 0.209 | 1.38 | 0.007 | 0.0041 | 0.0310 | 0.0024 | | | | | | | | | | |
| 30 | 0.29 | 0.226 | 1.66 | 0.010 | 0.0048 | 0.4610 | 0.0024 | | | | | | | | | | |
| 31 | 0.35 | 0.198 | 1.61 | 0.009 | 0.0031 | 0.5670 | 0.0025 | | | | | | | | | | |
| 32 | 0.31 | 0.221 | 1.24 | 0.009 | 0.0010 | 0.0373 | 0.0078 | | | | | | | | | | |
| 33 | 0.35 | 0.212 | 0.83 | 0.010 | 0.0002 | 0.0306 | 0.0091 | | | | | | | | | | |
| 34 | 0.32 | 0.210 | 0.90 | 0.007 | 0.0042 | 0.0183 | 0.0108 | | | | | | | | | | |
| 35 | 0.36 | 0.219 | 0.97 | 0.005 | 0.0018 | 0.0221 | 0.0021 | | | 0.012 | | | | | | | |
| 36 | 0.29 | 0.213 | 1.98 | 0.010 | 0.0046 | 0.0137 | 0.0024 | | | 0.038 | | | | | | | |
| 37 | 0.31 | 0.214 | 1.28 | 0.009 | 0.0012 | 0.0393 | 0.0047 | | | 0.078 | | | | | | | |
| 38 | 0.31 | 0.193 | 0.82 | 0.008 | 0.0046 | 0.0226 | 0.0018 | | | 0.142 | | | | | | | |
| 39 | 0.36 | 0.224 | 1.74 | 0.009 | 0.0004 | 0.0230 | 0.0040 | | | | | 0.011 | | | | | |
| 40 | 0.32 | 0.200 | 1.09 | 0.007 | 0.0011 | 0.0301 | 0.0027 | | | | | 0.026 | | | | | |
| 41 | 0.35 | 0.194 | 0.93 | 0.009 | 0.0014 | 0.0183 | 0.0029 | | | | | 0.141 | | | | | |
| 42 | 0.33 | 0.223 | 1.36 | 0.010 | 0.0007 | 0.0108 | 0.0026 | | | | | | 0.005 | | | | |
| 43 | 0.33 | 0.194 | 1.11 | 0.006 | 0.0033 | 0.0.357 | 0.0021 | | | | | | 0.010 | | | | |
| 44 | 0.32 | 0.192 | 1.53 | 0.006 | 0.0023 | 0.0166 | 0.0034 | | | | | | 0.984 | | | | |
| 45 | 0.36 | 0.196 | 1.85 | 0.010 | 0.0050 | 0.0130 | 0.0031 | | | | | | | 0.012 | | | |
| 46 | 0.36 | 0.200 | 1.93 | 0.005 | 0.0016 | 0.0378 | 0.0016 | | | | | | | 0.208 | | | |
| 47 | 0.31 | 0.191 | 1.64 | 0.008 | 0.0007 | 0.0127 | 0.0019 | | | | | | | 0.989 | | | |
| 48 | 0.36 | 0.204 | 1.79 | 0.009 | 0.0037 | 0.0472 | 0.0041 | | | | | | | | 0.0005 | | |
| 49 | 0.31 | 0.206 | 1.31 | 0.005 | 0.0050 | 0.0313 | 0.0023 | | | | | | | | 0.0021 | | |
| 50 | 0.32 | 0.230 | 1.81 | 0.007 | 0.0026 | 0.0116 | 0.0037 | | | | | | | | 0.0088 | | |
| 51 | 0.33 | 0.205 | 1.59 | 0.006 | 0.0019 | 0.0303 | 0.0024 | | | | | | | | | 0.009 | |
| 52 | 0.33 | 0.218 | 1.37 | 0.010 | 0.0021 | 0.0496 | 0.0018 | | | | | | | | | | 0.270 |
| 53 | 0.27 | 0.600 | 0.85 | 0.010 | 0.0020 | 0.0120 | 0.0050 | 0.26 | 0.13 | 0.050 | | 0.030 | 0.300 | | 0.0020 | | |
| 54 | 0.55 | 0.280 | 0.41 | 0.005 | 0.0004 | 0.0110 | 0.0030 | 0.30 | 0.10 | 0.030 | | 0.027 | 0.200 | | 0.002.3 | | |
| 55 | 0.30 | 0.470 | 0.65 | 0.010 | 0.0017 | 0.0130 | 0.0040 | 0.18 | 0.09 | 0.040 | | 0.040 | 0.220 | | 0.0022 | | |
| 56 | 0.42 | 0.370 | 0.56 | 0.010 | 0.0014 | 0.0110 | 0.0040 | 0.90 | 0.18 | 0.050 | 0.150 | 0.038 | 0.240 | | 0.0021 | | |
| 57 | 0.22 | 0.196 | 1.19 | 0.007 | 0.0006 | 0.0127 | 0.0025 | 0.16 | 0.08 | | | | | | | | |
| 58 | 0.21 | 0.197 | 1.18 | 0.006 | 0.0006 | 0.0127 | 0.0026 | 0.01 | | | | | | | | | |
| 59 | 0.21 | 0.195 | 1.20 | 0.007 | 0.0005 | 0.0128 | 0.0022 | | 0.01 | | | | | | | | |
| 60 | 0.20 | 0.199 | 1.17 | 0.008 | 0.0004 | 0.0128 | 0.0026 | | | | 0.090 | | | | | | |

| Steel No. | Ac3 point (° C.) | Note |
|---|---|---|
| 27 | 796 | Comparative Steel |
| 28 | 831 | Present Invention Steel |
| 29 | 821 | Present Invention Steel |
| 30 | 818 | Present Invention Steel |
| 31 | 805 | Comparative Steel |
| 32 | 822 | Present Invention Steel |
| 33 | 821 | Present Invention Steel |
| 34 | 827 | Comparative Steel |

TABLE 1-2-continued

| | | |
|---|---|---|
| 35 | 816 | Present Invention Steel |
| 36 | 811 | Present Invention Steel |
| 37 | 821 | Present Invention Steel |
| 38 | 830 | Present Invention Steel |
| 39 | 801 | Present Invention Steel |
| 40 | 822 | Present Invention Steel |
| 41 | 818 | Present Invention Steel |
| 42 | 815 | Present Invention Steel |
| 43 | 820 | Present Invention Steel |
| 44 | 830 | Present Invention Steel |
| 45 | 797 | Present Invention Steel |
| 46 | 793 | Present Invention Steel |
| 47 | 798 | Present Invention Steel |
| 48 | 799 | Present Invention Steel |
| 49 | 820 | Present Invention Steel |
| 50 | 809 | Present Invention Steel |
| 51 | 810 | Present Invention Steel |
| 52 | 815 | Present Invention Steel |
| 53 | 844 | Present Invention Steel |
| 54 | 775 | Present Invention Steel |
| 55 | 839 | Present Invention Steel |
| 56 | 780 | Present Invention Steel |
| 57 | 835 | Present Invention Steel |
| 58 | 845 | Present Invention Steel |
| 59 | 845 | Present Invention Steel |
| 60 | 848 | Present Invention Steel |

Underlines indicate that the corresponding values are outside the scope of the present invention.

TABLE 2-1

| | | Cooling | | Coiling | Plating | | | | | | | | | |
|---|---|---|---|---|---|---|---|---|---|---|---|---|---|---|
| | | | | | | | | Oxide coating | | | | | | |
| | | Cooling | | Coiling | Al-Si alloy plating | | | | Thick- | Ni plating layer | | | | |
| Steel sheet No. | Steel No. | start temper-ature (° C.) | Cooling rate (° C./second) | start temper-ature (° C.) | Al content (mass %) | Si content (mass %) | Thick-ness (μm) | Oxide coating removal | ness of oxide coating (nm) | Plating method | Ni content (mass %) | Thick-ness (nm) | Coverage (%) | Note |
| 1 | 1 | 1047 | 79 | 505 | 88 | 10 | 32 | Alkali | 4 | Electro plating | 75 | 225 | 96 | Comparative Example |
| 2 | 2 | 987 | 68 | 492 | 91 | 8 | 22 | Alkali | 8 | Electro plating | 97 | 427 | 97 | Present Invention Example |
| 3 | 3 | 1057 | 76 | 508 | 88 | 11 | 18 | Alkali | 9 | Electro plating | 98 | 471 | 97 | Present Invention Example |
| 4 | 4 | 1045 | 92 | 549 | 90 | 9 | 19 | Alkali | 6 | Electro plating | 96 | 629 | 98 | Present Invention Example |
| 5 | 5 | 947 | 71 | 468 | 89 | 9 | 35 | Alkali | 4 | Electro plating | 96 | 382 | 96 | Present Invention Example |
| 6 | 6 | 959 | 54 | 569 | 87 | 10 | 24 | Alkali | 10 | Electro plating | 97 | 449 | 95 | Present Invention Example |
| 7 | 7 | 940 | 50 | 429 | 93 | 6 | 29 | Alkali | 8 | Electro plating | 95 | 505 | 99 | Present Invention Example |
| 8 | 8 | 845 | 85 | 551 | 88 | 11 | 17 | Alkali | 8 | Electro plating | 95 | 494 | 98 | Comparative Example |
| 9 | 9 | 910 | 90 | 465 | 86 | 11 | 36 | Alkali | 7 | Electro plating | 97 | 471 | 98 | Present Invention Example |
| 10 | 10 | 1034 | 59 | 462 | 87 | 10 | 19 | Alkali | 10 | Electro plating | 96 | 617 | 96 | Present Invention Example |
| 11 | 11 | 962 | 66 | 597 | 86 | 12 | 23 | Alkali | 9 | Electro plating | 98 | 460 | 96 | Present Invention Example |
| 12 | 12 | 964 | 57 | 512 | 87 | 11 | 26 | Alkali | 3 | Electro plating | 98 | 370 | 99 | Present Invention Example |
| 13 | 13 | 957 | 61 | 547 | 88 | 9 | 19 | Alkali | 9 | Electro plating | 98 | 404 | 99 | Comparative Example |
| 14 | 14 | 1043 | 72 | 490 | 90 | 8 | 37 | Alkali | 3 | Electro plating | 97 | 685 | 98 | Present Invention Example |
| 15 | 15 | 925 | 70 | 537 | 86 | 12 | 18 | Alkali | 7 | Electro plating | 96 | 707 | 98 | Present Invention Example |
| 16 | 16 | 985 | 90 | 413 | 88 | 9 | 16 | Alkali | 3 | Electro plating | 99 | 629 | 95 | Present Invention Example |
| 17 | 17 | 975 | 96 | 506 | 89 | 8 | 39 | Alkali | 8 | Electro plating | 97 | 415 | 95 | Present Invention Example |
| 18 | 18 | 893 | 82 | 513 | 89 | 10 | 22 | Alkali | 10 | Electro plating | 98 | 685 | 98 | Present Invention Example |
| 19 | 19 | 1042 | 95 | 411 | 89 | 9 | 21 | Alkali | 8 | Electro plating | 95 | 471 | 97 | Present Invention Example |
| 20 | 20 | 957 | 70 | 498 | 86 | 12 | 26 | Alkali | 6 | Electro plating | 95 | 438 | 96 | Present Invention Example |
| 21 | 21 | 1050 | 92 | 544 | 88 | 10 | 38 | Alkali | 10 | Electro plating | 95 | 550 | 99 | Present Invention Example |
| 22 | 22 | 1049 | 86 | 576 | 88 | 11 | 34 | Alkali | 9 | Electro plating | 99 | 516 | 95 | Comparative Example |
| 23 | 23 | 1005 | 60 | 436 | 90 | 7 | 32 | Alkali | 5 | Electro plating | 96 | 348 | 96 | Present Invention Example |
| 24 | 24 | 944 | 87 | 591 | 91 | 6 | 32 | Alkali | 3 | Electro plating | 97 | 438 | 96 | Present Invention Example |

TABLE 2-1-continued

| | | Cooling | | Coiling | Plating | | | | | | | | | |
|---|---|---|---|---|---|---|---|---|---|---|---|---|---|---|
| | | | | | Al-Si alloy plating | | | Oxide coating | | Ni plating layer | | | | |
| Steel sheet No. | Steel No. | Cooling start temperature (° C.) | Cooling rate (° C./second) | Coiling start temperature (° C.) | Al content (mass %) | Si content (mass %) | Thickness (μm) | Oxide coating removal | Thickness of oxide coating (nm) | Plating method | Ni content (mass %) | Thickness (nm) | Coverage (%) | Note |
| 25 | 25 | 1035 | 68 | 519 | 92 | 6 | 35 | Alkali | 2 | Electro plating | 98 | 550 | 96 | Present Invention Example |
| 26 | 26 | 1038 | 68 | 448 | 88 | 11 | 23 | Alkali | 3 | Electro plating | 97 | 494 | 99 | Comparative Example |
| 27 | 27 | 977 | 93 | 424 | 89 | 8 | 31 | Alkali | 9 | Electro plating | 95 | 617 | 98 | Comparative Example |
| 28 | 28 | 948 | 92 | 471 | 91 | 6 | 32 | Alkali | 9 | Electro plating | 96 | 718 | 99 | Present Invention Example |
| 29 | 29 | 924 | 55 | 564 | 93 | 6 | 23 | Alkali | 8 | Electro plating | 97 | 561 | 95 | Present Invention Example |
| 30 | 30 | 1053 | 72 | 422 | 89 | 10 | 18 | Alkali | 5 | Electro plating | 98 | 370 | 95 | Present Invention Example |
| 31 | 31 | 1008 | 88 | 581 | 90 | 9 | 34 | Alkali | 10 | Electro plating | 95 | 617 | 96 | Comparative Example |
| 32 | 32 | 1041 | 57 | 591 | 85 | 12 | 26 | Alkali | 8 | Electro plating | 95 | 370 | 98 | Present Invention Example |
| 33 | 33 | 1014 | 54 | 591 | 92 | 7 | 22 | Alkali | 2 | Electro plating | 97 | 404 | 96 | Present Invention Example |
| 34 | 34 | 968 | 87 | 420 | 88 | 9 | 34 | Alkali | 9 | Electro plating | 96 | 359 | 95 | Comparative Example |
| 35 | 35 | 958 | 53 | 580 | 88 | 10 | 31 | Alkali | 8 | Electro plating | 98 | 483 | 95 | Present Invention |
| 36 | 36 | 1013 | 70 | 502 | 89 | 10 | 33 | Alkali | 4 | Electro plating | 98 | 539 | 99 | Present Invention Example |

Underlines indicate that the corresponding values arc outside the scope of the pr9esent invention.

TABLE 2-2

| | | Cooling | | Coiling | Plating | | | | | | | | | |
|---|---|---|---|---|---|---|---|---|---|---|---|---|---|---|
| | | | | | Al-Si alloy plating | | | Oxide coating | | Ni plating layer | | | | |
| Steel sheet No. | Steel No. | Cooling start temperature (° C.) | Cooling rate (° C./second) | Coiling start temperature (° C.) | Al content (mass %) | Si content (mass %) | Thickness (μm) | Oxide coating removal | Thickness of oxide coating (nm) | Plating method | Ni content (mass %) | Thickness Thickness (nm) | Coverage (%) | Note |
| 37 | 37 | 967 | 58 | 583 | 89 | 8 | 27 | Alkali | 4 | Electro plating | 99 | 584 | 99 | Present Invention Example |
| 38 | 38 | 990 | 50 | 551 | 87 | 10 | 23 | Alkali | 6 | Electro plating | 99 | 573 | 98 | Present Invention Example |
| 39 | 39 | 971 | 55 | 540 | 90 | 9 | 16 | Alkali | 6 | Electro plating | 98 | 584 | 99 | Present Invention Example |
| 40 | 40 | 1006 | 56 | 575 | 89 | 8 | 31 | Alkali | 5 | Electro plating | 96 | 651 | 98 | Present Invention Example |
| 41 | 41 | 969 | 92 | 452 | 90 | 9 | 16 | Alkali | 8 | Electro plating | 96 | 584 | 98 | Present Invention Example |
| 42 | 42 | 991 | 64 | 441 | 90 | 7 | 27 | Alkali | 7 | Electro plating | 99 | 348 | 95 | Present Invention Example |

TABLE 2-2-continued

| | | Cooling | | Coiling | Plating | | | | | | | | | |
|---|---|---|---|---|---|---|---|---|---|---|---|---|---|---|
| | | | | | Al-Si alloy plating | | | Oxide coating | | Ni plating layer | | | | |
| Steel sheet No. | Steel No. | Cooling start temperature (° C.) | Cooling rate (° C./second) | Coiling start temperature (° C.) | Al content (mass %) | Si content (mass %) | Thickness (μm) | Oxide coating removal | Thickness of oxide coating (nm) | Plating method | Ni content (mass %) | Thickness Thickness (nm) | Coverage (%) | Note |
| 43 | 43 | 938 | 96 | 589 | 89 | 9 | 28 | Alkali | 5 | Electro plating | 95 | 674 | 97 | Present Invention Example |
| 44 | 44 | 1065 | 64 | 559 | 89 | 8 | 29 | Alkali | 10 | Electro plating | 97 | 370 | 96 | Present Invention Example |
| 45 | 45 | 1047 | 83 | 581 | 88 | 11 | 26 | Alkali | 4 | Electro plating | 96 | 539 | 95 | Present Invention Example |
| 46 | 46 | 900 | 94 | 585 | 89 | 10 | 22 | Alkali | 9 | Electro plating | 97 | 471 | 96 | Present Invention Example |
| 47 | 47 | 1031 | 62 | 531 | 89 | 8 | 36 | Alkali | 8 | Electro plating | 99 | 494 | 98 | Present Invention Example |
| 48 | 48 | 928 | 93 | 416 | 88 | 10 | 18 | Alkali | 5 | Electro plating | 97 | 337 | 96 | Present Invention Example |
| 49 | 49 | 952 | 76 | 493 | 89 | 8 | 26 | Alkali | 2 | Electro plating | 96 | 539 | 98 | Present Invention Example |
| 50 | 50 | 979 | 58 | 502 | 86 | 11 | 21 | Alkali | 8 | Electro plating | 99 | 606 | 98 | Present Invention Example |
| 51 | 51 | 958 | 50 | 446 | 88 | 9 | 22 | Acid | 7 | Electro plating | 95 | 393 | 98 | Present Invention Example |
| 52 | 52 | 1012 | 56 | 571 | 87 | 12 | 18 | Alkali | 9 | Deposition | 96 | 617 | 99 | Present Invention Example |
| 53 | 4 | 828 | 96 | 460 | 89 | 8 | 23 | Alkali | 3 | Electro plating | 99 | 471 | 96 | Present Invention Example |
| 54 | 4 | 781 | 87 | 585 | 90 | 7 | 27 | Alkali | 6 | Electro plating | 95 | 236 | 97 | Present Invention Example |
| 55 | 4 | 1001 | 32 | 424 | 89 | 8 | 29 | Alkali | 9 | Electro plating | 98 | 471 | 95 | Present Invention Example |
| 56 | 4 | 989 | 26 | 498 | 91 | 8 | 35 | Alkali | 3 | Electro plating | 96 | 247 | 99 | Present Invention Example |
| 57 | 4 | 919 | 82 | 480 | 87 | 11 | 38 | Alkali | 10 | Electro plating | 99 | 707 | 95 | Present Invention Example |
| 58 | 4 | 1025 | 74 | 595 | 85 | 12 | 34 | Alkali | 3 | Electro plating | 98 | 528 | 97 | Present Invention Example |
| 59 | 4 | 943 | 65 | 624 | 91 | 6 | 28 | Alkali | 2 | Electro plating | 99 | 225 | 95 | Present Invention Example |
| 60 | 4 | 1040 | 66 | 475 | 92 | 6 | 31 | Alkali | 4 | Electro plating | 98 | 662 | 99 | Present Invention Example |
| 61 | 4 | 1056 | 86 | 537 | 80 | 17 | 19 | Alkali | 6 | Electro plating | 97 | 516 | 99 | Present Invention Example |
| 62 | 4 | 983 | 75 | 412 | 90 | 7 | 8 | Alkali | 3 | Electro plating | 96 | 326 | 98 | Present Invention Example |
| 63 | 4 | 919 | 56 | 595 | 87 | 11 | 6 | Alkali | 4 | Electro plating | 97 | 640 | 98 | Comparative Example |
| 64 | 4 | 1023 | 61 | 547 | 91 | 8 | 30 | Alkali | 0 | Electro plating | 99 | 674 | 99 | Present Invention Example |
| 65 | 4 | 1056 | 78 | 561 | 86 | 11 | 35 | Alkali | 16 | Electro plating | 96 | 640 | 95 | Present Example Invention |

TABLE 2-2-continued

| | | Cooling | | Coiling | Plating | | | | | | | | | |
|---|---|---|---|---|---|---|---|---|---|---|---|---|---|---|
| | | | | | Al-Si alloy plating | | | Oxide coating | | Ni plating layer | | | | |
| Steel sheet No. | Steel No. | Cooling start temperature (° C.) | Cooling rate (° C./second) | Coiling start temperature (° C.) | Al content (mass %) | Si content (mass %) | Thickness (μm) | Oxide coating removal | Thickness of oxide coating (nm) | Plating method | Ni content (mass %) | Thickness Thickness (nm) | Coverage (%) | Note |
| 66 | 4 | 1034 | 58 | 587 | 89 | 9 | 34 | None | 28 | Electro plating | 98 | 359 | 83 | Comparative Example |
| 67 | 4 | 1037 | 60 | 582 | 91 | 7 | 34 | Alkali | 3 | Electro plating | 92 | 539 | 97 | Present Invention Example |
| 68 | 4 | 1032 | 86 | 516 | 90 | 7 | 28 | Alkali | 3 | Electro plating | 85 | 225 | 97 | Comparative Example |
| 69 | 4 | 1037 | 66 | 488 | 91 | 8 | 26 | Alkali | 4 | None | 0 | 0 | 0 | Comparative Example |
| 70 | 4 | 935 | 73 | 579 | 89 | 10 | 31 | Alkali | 8 | Electro plating | 95 | 180 | 97 | Comparative Example |
| 71 | 4 | 1060 | 51 | 529 | 89 | 9 | 19 | Alkali | 8 | Electro plating | 98 | 213 | 95 | Present Invention Example |
| 72 | 4 | 973 | 91 | 588 | 85 | 12 | 26 | Alkali | 8 | Electro plating | 97 | 2223 | 99 | Present Invention Example |
| 73 | 4 | 1027 | 79 | 531 | 92 | 8 | 29 | Alkali | 20 | Electro plating | 98 | 452 | 98 | Present Invention Example |
| 74 | 4 | 1027 | 79 | 531 | 92 | 8 | 30 | Alkali | 21 | Electro plating | 98 | 451 | 89 | Comparative Example |
| 75 | 53 | 980 | 88 | 621 | 92 | 8 | 41 | Alkali | 8 | Electro plating | 99 | 1199 | 99 | Present Invention Example |
| 76 | 54 | 1026 | 90 | 624 | 92 | 6 | 39 | Alkali | 5 | Electro plating | 99 | 917 | 99 | Present Invention Example |
| 77 | 55 | 998 | 97 | 620 | 92 | 7 | 33 | Alkali | 3 | Electro plating | 99 | 1018 | 99 | Present Invention Example |
| 78 | 56 | 1031 | 91 | 625 | 92 | 8 | 29 | Alkali | 2 | Electro plating | 99 | 1530 | 99 | Present Invention Example |
| 79 | 57 | 985 | 92 | 630 | 93 | 7 | 30 | Alkali | 15 | Electro plating | 99 | 645 | 98 | Present Invention Example |
| 80 | 58 | 1004 | 95 | 609 | 93 | 6 | 35 | Alkali | 12 | Electro plating | 99 | 984 | 98 | Present Invention Example |
| 81 | 59 | 981 | 90 | 622 | 92 | 7 | 20 | Alkali | 11 | Electro plating | 98 | 1143 | 97 | Present Invention Example |
| 82 | 60 | 1030 | 73 | 608 | 91 | 8 | 40 | Alkali | 9 | Electro plating | 96 | 2185 | 99 | Present Invention Example |

Underlines indicate that the corresponding values are outside the scope of the present invention.

(Al—Si Plating)

On the steel sheets manufactured as described above, Al—Si alloy plating was provided. In hot-dip plating baths of Al—Si alloys, the components of the plating baths were adjusted such that the Al content and the Si content became as shown in Tables 2-1 and 2-2. The steel sheets manufactured by the above-described method were immersed in the plating baths having the adjusted components, thereby obtaining Al—Si alloy-plated steel sheets shown in Tables 2-1 and 2-2.

(Removal of Al Oxide Coating)

Al oxide coatings on the surfaces of the Al—Si plating steel sheets were removed by methods shown in Tables 2-1 and 2-2. In a case where "alkali" is shown in Tables 2-1 and 2-2, 0.1 mol/L of a sodium hydroxide aqueous solution was used as a removal solution. In a case where "acid" is shown in Tables 2-1 and 2-2, 0.1 mol/L of dilute hydrochloric acid was used as a removal solution. The Al—Si plating steel sheets obtained above were immersed in the removal solutions, thereby obtaining Al oxide coating-removed steel sheets.

(Ni Plating)

Next, Ni plating was provided on the Al oxide coating-removed steel sheets. As a Ni plating bath, a Watt bath containing 200 to 400 g/L of nickel sulfate, 20 to 100 g/L of nickel chloride and 5 to 50 g/L of boric acid was used. The proportions of nickel sulfate, nickel chloride and boric acid were adjusted such that the Ni content became as shown in Tables 2-1 and 2-2, the pHs were adjusted to 1.5 to 2.5, and the bath temperatures were adjusted to 45° C. to 55° C. Soluble Ni was used as an anode, the current density was set to 2 A/dm$^2$, and the energization times were controlled such that the thicknesses became as shown in Tables 2-1 and 2-2, thereby obtaining steel sheets for hot stamping. In the steel sheets for hot stamping for which "deposition" is shown in Tables 2-1 and 2-2, Ni plating layers were formed not by electro plating but by deposition. Deposition plating was carried out at a degree of vacuum during deposition of $5.0\times10^{-3}$ to $2.0\times10^{-5}$ Pa, and electron beams (voltage: 10 V, current: 1.0 A) were used as a radiation source for deposition. Individual structures of the base materials of the obtained steel sheets for hot stamping were confirmed by the above-described method, and it was found that, in the area ratio of a cross section, ferrite was 20% to 80%, pearlite was 20% to 80% and the reminder was less than 5%.

(Hot Stamping)

Next, the steel sheets for hot stamping were hot-stamped in a high-dew point environment (dew point: 30° C.) under conditions as shown in Tables 3-1 and 3-2, thereby obtaining hot-stamping formed bodies.

(Measurement of Dislocation Density)

A sample was cut out from an arbitrary position 50 mm or more apart from the end face of the steel sheet manufactured above. The size of the sample was set to 20 mm×20 mm. The thickness of the sample was reduced by 200 μm using a solution mixture of 48 mass % of diluted water, 48 mass % of hydrogen peroxide water and 4 mass % of hydrofluoric acid. At this time, the front surface and the rear surface of the sample were each reduced by 100 μm, and 100 μm regions were exposed from the surfaces of the sample to be depressurized. X-ray diffraction measurement was carried out on these exposed surfaces, and a plurality of diffraction peaks of body-centered cubic lattices was specified. The dislocation densities were analyzed from the half-value widths of these diffraction peaks, thereby obtaining the dislocation density at a depth of 100 μm from the surface. As an analysis method, a modified Williamson-Hall method described in Non-Patent Document 1 was used. The obtained results are shown in Tables 3-1 and 3-2. When the Ni plating layers and Al—Si alloy plating layers of the steel sheets for hot stamping manufactured above were removed using a NaOH aqueous solution and then the dislocation densities were measured, the results were the same as in Table 3-1 and Table 3-2.

(Thickness of Al—Si Alloy Plating Layer)

The thickness of the Al—Si alloy plating layer was measured as described below. The steel sheet for hot stamping obtained by the above-described manufacturing method was cut in the sheet thickness direction. After that, the cross section of the steel sheet for hot stamping was polished, in the polished cross section of the steel sheet for hot stamping, a region from the surface of the steel sheet for hot stamping to the steel sheet was linearly analyzed using a ZAF method by FE-EPMA, and the Al concentration and the Si concentration in the detected components were measured. As the measurement conditions, the accelerating voltage was set to 15 kV, the beam diameter was set to approximately 100 nm, the irradiation time per point was set to 1000 ms, and the measurement pitches were set to 60 nm. The measurement was carried out in a range where the Ni plating layer, the Al—Si alloy plating layer and the steel sheet were included. A region where the Al content was 75 mass % or more, the Si content was 3 mass % or more and the total of the Al content and the Si content was 95 mass % or more was determined as the Al—Si alloy plating layer, and the thickness of the Al—Si alloy plating layer was regarded as the length of the region in the sheet thickness direction. The thicknesses of the Al—Si alloy plating layer were measured at five positions at 5 intervals, and the arithmetic average of the obtained values was regarded as the thickness of the Al—Si alloy plating layer. The evaluation results are shown in Tables 2-1 and 2-2.

(Measurement of Al Content and Si Content in Al—Si Alloy Plating Layer)

Regarding the Al content and the Si content in the Al—Si alloy plating layer, according to a testing method described in JIS K 0150 (2005), a test piece is collected, the Al content and the Si content are measured at a ½ position of the total thickness of the Al—Si alloy plating layer, whereby the Al content and the Si content in the Al—Si alloy plating layer in the steel sheet for hot stamping 10 were obtained. The obtained results are shown in Tables 2-1 and 2-2.

(Thickness of Al Oxide Coating)

The thickness of the Al oxide coating was evaluated by alternately repeating Ar sputtering and X-ray photoelectron spectroscopy (XPS) measurement. Specifically, the steel sheet for hot stamping was sputtered by Ar sputtering (accelerating voltage: 0.5 kV, sputtering rate based on $SiO_2$: 0.5 nm/min), and then XPS measurement was carried out. The XPS measurement was carried out using Al Kα rays as a radiation source under conditions of an output of 15 kV, 25 W, a spot size of 100 μm, the number of times of scanning of 10 times and an entire energy range of 0 to 1300 eV. The Ar sputtering and the XPS measurement were alternately carried out, and these measurements were repeated until a peak with a bonding energy of the 2p orbit of Al in the XPS measurement of 73.8 eV to 74.5 eV appeared and then disappeared. The thickness of the Al oxide coating was calculated from the sputtering time and the sputtering rate from a position where the O content reached 20 atomic % or more for the first time after the start of the sputtering to a position where the O content reached less than 20 atomic %. The sputtering rate is obtained in terms of $SiO_2$. The thickness of the Al oxide coating was the arithmetic average value of two measurement sites. The obtained results are shown in Tables 2-1 and 2-2.

(Thickness of Ni Plating Layer)

The thickness of the Ni plating layer 4 is measured by alternately repeating Ar sputtering etching and X-ray photoelectron spectroscopy (XPS) measurement. Specifically, the steel sheet for hot stamping 10 is sputtering-etched by Ar sputtering (accelerating voltage: 20 kV, sputtering rate: 1.0 nm/min), and then XPS measurement is carried out. The Ar sputtering etching and the XPS measurement are alternately carried out, and these measurements are repeated until a peak with a bonding energy of the 2p orbit of Ni in the XPS measurement of 852.5 eV to 852.9 eV appears and then disappears. The layer thickness of the Ni plating layer 4 is calculated from the sputtering etching time and the sputtering etching rate while the peak in the above-described range from a position where the Ni content reaches 10 atomic % or more for the first time after the start of the sputtering to a position where the Ni content reaches less than 10 atomic % appears and then disappears. The sputtering etching rate is obtained in terms of $SiO_2$. The thickness of the Ni plating layer 4 is the arithmetic average value of two measurement sites.

(Ni Content of Ni Plating Layer)

Regarding the Ni content in the Ni plating layer, the Ni concentration at the central position in the sheet thickness direction of the Ni plating layer that was obtained in the measurement of the thickness of the Ni plating layer was regarded as the Ni content. Specifically, the arithmetic average (N=2) of values obtained in the measurement at the central position of the Ni plating layer in the sheet thickness direction was regarded as the Ni content. The obtained results are shown in Tables 2-1 and 2-2.

(Coverage of Ni Plating Layer)

The coverage of the Ni plating layer was evaluated by XPS measurement. The XPS measurement was carried out by scanning the steel sheet for hot stamping 10 in the entire energy range of 0 to 1300 eV using Al Kα rays as a radiation source under conditions of an output of 15 kV, 25 W, a spot size of 100 μm and the number of times of scanning of 10 times, and the Ni content (atomic %) and the Al content (atomic %) were calculated. Next, the proportion (%) of the Ni content in the total of the Ni content and the Al content was calculated, and the obtained proportion was regarded as the coverage (%) of the Ni plating. The obtained results are shown in Tables 2-1 and 2-2.

(Tensile Strength)

The tensile strength of the hot-stamping formed body was obtained according to the testing method described in JIS Z 2241: 2011 after a No. 5 test piece described in JIS Z 2241: 2011 was produced from an arbitrary position in the hot-stamping formed body. Test No. 63 where the scale state was poor was not evaluated. The measured measurement results are shown in Tables 3-1 and 3-2. In Tables 3-1 and 3-2, "early breakage" indicates tests where there was no yield point, the hot-stamping formed body broke while the numerical value was increasing, and the displacement at breakage in the measurement range of the tensile strength became the maximum value of the tensile strength (that is, tests where the hot-stamping formed body did not elongate but broke after the maximum load).

(Amount of Hydrogen Intruding in Heating Furnace)

Thermal hydrogen analysis was carried out on the hot-stamping formed body, and the amount of intruding hydrogen intruding into a heating furnace was measured. The hot-stamping formed body was cooled to 200° C. or lower with a die for hot stamping, immediately cooled to −10° C. or lower with liquid nitrogen to be frozen, and the amount of intruding hydrogen (mass ppm) of the hot-stamping formed body was evaluated using the amount of diffusible hydrogen that was discharged up to 300° C. in the thermal hydrogen analysis. In a case where the amount of intruding hydrogen was 0.350 mass ppm or less, it was determined that the amount of intruding hydrogen could be suppressed even in a high-dew point environment and the amount of intruding hydrogen was evaluated as acceptable. In a case where the amount of intruding hydrogen was more than 0.350 mass ppm, the amount of intruding hydrogen was evaluated as unacceptable. In Test No. 63 where the scale state was poor, the amount of hydrogen was not measured. In addition, in Test Nos. 8, 13, 22, 26, 27, 31 and 34 where the hot-stamping formed body broke early, the amounts of hydrogen were not measured. The measurement results are shown in Tables 3-1 and 3-2.

TABLE 3-1

| | | Steel sheet | Hot stamping step | | | Properties | | |
|---|---|---|---|---|---|---|---|---|
| | | Average | Heating | | | Mechanical | Hydrogen Concentration | |
| Steel sheet No. | Steel No. | dislocation density of surface ($10^{13}$ m/m$^3$) | Heating rate (° C./second) | target temperature (° C.) | Retention time (seconds) | properties Tensile strength (MPa) | of hydrogen intruding in heating furnace (mass ppm) | Note |
| 1 | 1 | 44 | 4.9 | 908 | 71 | 1558 | 0.382 | Comparative Example |
| 2 | 2 | 49 | 2.7 | 879 | 105 | 1583 | 0.223 | Present Invention Example |
| 3 | 3 | 48 | 3.8 | 891 | 113 | 1669 | 0.281 | Present Invention Example |
| 4 | 4 | 46 | 4.6 | 877 | 115 | 1980 | 0.256 | Present Invention Example |
| 5 | 5 | 81 | 3.3 | 881 | 82 | 2199 | 0.310 | Present Invention Example |
| 6 | 6 | 35 | 2.7 | 896 | 109 | 2411 | 0.286 | Present Invention Example |
| 7 | 7 | 176 | 4.0 | 861 | 67 | 2656 | 0.293 | Present Invention Example |
| 8 | 8 | 107 | 5.8 | 876 | ill | Early breakage | | Comparative Example |
| 9 | 9 | 75 | 2.1 | 873 | 107 | 1586 | 0.322 | Present Invention Example |
| 10 | 10 | 69 | 3.6 | 893 | 107 | 1889 | 0.281 | Present Invention Example |
| 11 | 11 | 31 | 4.3 | 918 | 105 | 1961 | 0.266 | Present Invention Example |
| 12 | 12 | 67 | 4.2 | 912 | 69 | 2275 | 0.241 | Present Invention Example |
| 13 | 13 | 53 | 3.9 | 892 | 83 | Early breakage | | Comparative Example |
| 14 | 14 | 94 | 5.6 | 911 | 119 | 2497 | 0.198 | Present Invention Example |
| 15 | 15 | 58 | 3.6 | 894 | 92 | 2297 | 0.229 | Present Invention Example |
| 16 | 16 | 91 | 5.5 | 918 | 118 | 2074 | 0.246 | Present Invention Example |
| 17 | 17 | 58 | 3.3 | 864 | 103 | 1907 | 0.287 | Present Invention Example |
| 18 | 18 | 65 | 4.9 | 893 | 69 | 2199 | 0.294 | Present Invention Example |
| 19 | 19 | 80 | 6.0 | 876 | 119 | 1799 | 0.271 | Present Invention Example |
| 20 | 20 | 58 | 3.7 | 911 | 115 | 1889 | 0.298 | Present Invention Example |
| 21 | 21 | 46 | 5.0 | 906 | 84 | 1926 | 0.293 | Present Invention Example |
| 22 | 22 | 21 | 5.0 | 910 | 80 | Early breakage | | Comparative Example |
| 23 | 23 | 81 | 2.5 | 875 | 76 | 1980 | 0.284 | Present Invention Example |
| 24 | 24 | 26 | 6.0 | 893 | 104 | 2220 | 0.288 | Present Invention Example |
| 25 | 25 | 63 | 5.1 | 866 | 72 | 2220 | 0.263 | Present Invention Example |
| 26 | 26 | 75 | 5.7 | 914 | 119 | Early breakage | | Comparative Example |
| 27 | 27 | 99 | 4.1 | 885 | 116 | Early breakage | | Comparative Example |
| 28 | 28 | 64 | 4.9 | 880 | 79 | 1799 | 0.216 | Present Invention Example |
| 29 | 29 | 40 | 2.6 | 887 | 74 | 1963 | 0.251 | Present Invention Example |
| 30 | 30 | 80 | 4.0 | 874 | 92 | 1871 | 0.289 | Present Invention Example |
| 31 | 31 | 26 | 3.3 | 877 | 110 | Early breakage | | Comparative Example |

TABLE 3-1-continued

| Steel sheet No. | Steel No. | Steel sheet: Average dislocation density of surface ($10^{13}$ m/m$^3$) | Hot stamping step: Heating: Heating rate (° C./second) | Hot stamping step: Heating: target temperature (° C.) | Hot stamping step: Heating: Retention time (seconds) | Properties: Mechanical properties Tensile strength (MPa) | Properties: Hydrogen Concentration of hydrogen intruding in heating furnace (mass ppm) | Note |
|---|---|---|---|---|---|---|---|---|
| 32 | 32 | 16 | 3.9 | 881 | 79 | 1980 | 0.293 | Present Invention Example |
| 33 | 33 | 35 | 4.8 | 871 | 98 | 2220 | 0.291 | Present Invention Example |
| 34 | 34 | 89 | 4.2 | 903 | 66 | Early breakage | | Comparative Example |
| 35 | 35 | 20 | 5.5 | 877 | 102 | 2275 | 0.293 | Present Invention Example |
| 36 | 36 | 57 | 4.8 | 871 | 86 | 1871 | 0.286 | Present Invention Example |

TABLE 3-2

| Steel sheet No. | Steel No. | Steel sheet: Average dislocation density of surface ($10^{13}$ m/m$^3$) | Hot stamping step: Heating: Heating rate (° C./second) | Hot stamping step: Heating: target temperature (° C.) | Hot stamping step: Heating: Retention time (seconds) | Properties: Mechanical properties Tensile strength (MPa) | Properties: Hydrogen Concentration of hydrogen intruding in heating furnace (mass ppm) | Note |
|---|---|---|---|---|---|---|---|---|
| 37 | 37 | 17 | 5.7 | 884 | 70 | 1961 | 0.266 | Present Invention Example |
| 38 | 38 | 46 | 6.0 | 898 | 66 | 1980 | 0.248 | Present Invention Example |
| 39 | 39 | 57 | 5.0 | 862 | 106 | 2231 | 0.276 | Present Invention Example |
| 40 | 40 | 40 | 2.2 | 881 | 107 | 2074 | 0.251 | Present Invention Example |
| 41 | 41 | 86 | 5.3 | 860 | 74 | 2177 | 0.276 | Present Invention Example |
| 42 | 42 | 85 | 3.6 | 888 | 66 | 2130 | 0.274 | Present Invention Example |
| 43 | 43 | 36 | 4.3 | 915 | 98 | 2110 | 0.256 | Present Invention Example |
| 44 | 44 | 45 | 3.8 | 905 | 91 | 2035 | 0.268 | Present Invention Example |
| 45 | 45 | 22 | 4.5 | 911 | 117 | 2253 | 0.296 | Present Invention Example |
| 46 | 46 | 25 | 2.9 | 892 | 82 | 2231 | 0.281 | Present Invention Example |
| 47 | 47 | 52 | 4.3 | 913 | ill | 1961 | 0.286 | Present Invention Example |
| 48 | 48 | 102 | 4.3 | 872 | 102 | 2275 | 0.298 | Present Invention Example |
| 49 | 49 | 64 | 5.9 | 919 | 94 | 1961 | 0.286 | Present Invention Example |
| 50 | 50 | 63 | 2.2 | 900 | 77 | 2074 | 0.281 | Present Invention Example |
| 51 | 51 | 83 | 3.5 | 860 | 95 | 2130 | 0.285 | Present Invention Example |
| 52 | 52 | 42 | 2.8 | 879 | 63 | 2089 | 0.279 | Present Invention Example |
| 53 | 4 | 74 | 5.3 | 910 | 113 | 1999 | 0.281 | Present Invention Example |
| 54 | 4 | 4 | 3.2 | 902 | 113 | 1980 | 0.346 | Present Invention Example |
| 55 | 4 | 85 | 2.8 | 887 | 102 | 2019 | 0.271 | Present Invention Example |
| 56 | 4 | 3 | 5.1 | 906 | 94 | 1961 | 0.339 | Present Invention Example |
| 57 | 4 | 202 | 5.9 | 860 | 67 | 1999 | 0.229 | Present Invention Example |
| 58 | 4 | 5 | 4.9 | 900 | 68 | 2019 | 0.278 | Present Invention Example |
| 59 | 4 | 1 | 2.8 | 900 | 75 | 2019 | 0.341 | Present Invention Example |
| 60 | 4 | 69 | 3.2 | 914 | 66 | 1961 | 0.259 | Present Invention Example |
| 61 | 4 | 50 | 3.7 | 919 | 72 | 2019 | 0.297 | Present Invention Example |
| 62 | 4 | 89 | 3.0 | 894 | 71 | 2019 | 0.279 | Present Invention Example |
| 63 | 4 | 32 | 5.0 | 920 | 103 | Not evaluated due to scale deterioration | | Comparative Example |
| 64 | 4 | 37 | 2.8 | 896 | 60 | 1972 | 0.184 | Present Invention Example |
| 65 | 4 | 43 | 4.6 | 894 | 95 | 2019 | 0.274 | Present Invention Example |
| 66 | 4 | 33 | 5.0 | 915 | 95 | 2019 | 0.415 | Comparative Example |
| 67 | 4 | 36 | 5.2 | 895 | 66 | 1961 | 0.256 | Present Invention Example |
| 68 | 4 | 57 | 6.0 | 920 | 119 | 1999 | 0.361 | Comparative Example |
| 69 | 4 | 56 | 3.8 | 904 | 48 | 1972 | 0.913 | Comparative Example |
| 70 | 4 | 19 | 5.1 | 900 | 63 | 1980 | 0.462 | Comparative Example |
| 71 | 4 | 53 | 5.7 | 890 | 88 | 1961 | 0.288 | Present Invention Example |
| 72 | 4 | 29 | 3.5 | 860 | 100 | 1980 | 0.127 | Present Invention Example |
| 73 | 4 | 46 | 2.7 | 900 | 61 | 1980 | 0.341 | Present Invention Example |
| 74 | 4 | 46 | 2.7 | 900 | 62 | 1972 | 0.362 | Comparative Example |
| 75 | 53 | 42 | 4.9 | 887 | 61 | 1975 | 0.158 | Present Invention Example |
| 76 | 54 | 65 | 5.9 | 890 | 60 | 1969 | 0.163 | Present Invention Example |
| 77 | 55 | 38 | 5.1 | 907 | 62 | 1971 | 0.152 | Present Invention Example |
| 78 | 56 | 54 | 4.3 | 906 | 63 | 1968 | 0.159 | Present Invention Example |
| 79 | 57 | 31 | 4.5 | 893 | 79 | 1912 | 0.281 | Present Invention Example |

TABLE 3-2-continued

| Steel sheet No. | Steel No. | Steel sheet: Average dislocation density of surface ($10^{13}$ m/m$^3$) | Hot stamping step: Heating: Heating rate (° C./second) | Hot stamping step: Heating: target temperature (° C.) | Hot stamping step: Heating: Retention time (seconds) | Properties: Mechanical properties Tensile strength (MPa) | Properties: Hydrogen Concentration of hydrogen intruding in heating furnace (mass ppm) | Note |
|---|---|---|---|---|---|---|---|---|
| 80 | 58 | 48 | 4.0 | 922 | 65 | 1923 | 0.294 | Present Invention Example |
| 81 | 59 | 58 | 3.8 | 1003 | 56 | 1934 | 0.283 | Present Invention Example |
| 82 | 60 | 39 | 8.4 | 855 | 199 | 1941 | 0.287 | Present Invention Example |

Underlines indicate that the corresponding values are outside the scope of the present invention.

As shown in Tables 3-1 and 3-2, in Test Nos. 2 o 7, 9 to 12, 14 to 21, 23 to 25, 28 to 30, 32, 33, 35 to 62, 64, 65, 67, 71 to 73 and 75 to 82 that satisfied the scope of the present invention, the amounts of intruding hydrogen in the heating furnace were also small.

In Test No. 1, since the Ni content in the Ni plating layer was 75%, a large amount of hydrogen intruded into the steel sheet.

In Test No. 8, since the C content in the steel sheet was 0.70% or more, the hot-stamping formed body broke early due to hydrogen embrittlement cracking.

In Test No. 13, since the Mn content in the steel sheet was less than 0.40%, the hot-stamping formed body broke early due to hydrogen embrittlement cracking.

In Test No. 22, since the P content in the steel sheet was more than 0.100%, the hot-stamping formed body broke early due to hydrogen embrittlement cracking.

In Test No. 26, since the S content in the steel sheet was more than 0.1000%, the hot-stamping formed body broke early due to hydrogen embrittlement cracking.

In Test No. 27, since the sol. Al content in the steel sheet was less than 0.0002%, the hot-stamping formed body broke early due to hydrogen embrittlement cracking.

In Test No. 31, since the sol. Al content in the steel sheet was more than 0.5000%, the hot-stamping formed body broke early due to hydrogen embrittlement breakage.

In Test No. 34, since the N content in the steel sheet was more than 0.0100%, the hot-stamping formed body broke early due to hydrogen embrittlement cracking.

In Test No. 54, the tensile strength and the amount of intruding hydrogen satisfied the acceptance criteria, but the cooling start temperature was lower than the $Ac_3$ point, and thus the average dislocation density was low, and the amount of intruding hydrogen was higher than those of the other invention examples.

In Test No. 56, the tensile strength and the amount of intruding hydrogen satisfied the acceptance criteria, but the cooling rate was slower than 30° C./second, and thus the average dislocation density was low, and the amount of intruding hydrogen was higher than those of the other invention examples.

In Test No. 59, the tensile strength and the amount of intruding hydrogen satisfied the acceptance criteria, but the coiling start temperature was higher than 600° C., and thus the average dislocation density was low, and the amount of intruding hydrogen was higher than those of the other invention examples.

In Test No. 63, since the thickness of the Al—Si alloy plating layer was less than 7 the scale state was poor.

In Test No. 66, since the thickness of the Al oxide coating was more than 20 nm, a large amount of hydrogen intruded into the steel sheet.

In Test No. 68, since the Ni content in the Ni plating layer was 85%, a large amount of hydrogen intruded into the steel sheet.

In Test No. 69, since no Ni plating layer was provided, a large amount of hydrogen intruded into the steel sheet.

In Test No. 70, since the thickness of the Ni plating layer was 200 nm or less, a large amount of hydrogen intruded into the steel sheet.

In Test No. 74, since the Al oxide coating was 21 nm, the upper layer plating coating (Ni plating layer) exfoliated, and a large amount of hydrogen intruded into the steel sheet.

INDUSTRIAL APPLICABILITY

According to the present invention, even a steel sheet for hot stamping provided with Al plating has excellent hydrogen embrittlement resistance even during hot stamping in a high-dew point environment by reducing the amount of intruding hydrogen, and thus the present invention is highly available industrially.

BRIEF DESCRIPTION OF THE REFERENCE SYMBOLS

1 Base material
2 Al—Si alloy plating layer
3 Al oxide coating
4 Ni plating layer
10 Steel sheet for hot stamping

The invention claimed is:

1. A steel sheet for hot stamping comprising:

a base material;

an Al—Si alloy plating layer in which an Al content is 75 mass % or more, a Si content is 3 mass % or more and a total of the Al content and the Si content is 95 mass % or more;

an Al oxide coating having a thickness of 0 to 4 nm; and a Ni plating layer having a Ni content of more than 90 mass % in this order, wherein the base material has a chemical composition of, by mass %, C: 0.01% or more and less than 0.70%;
Si: 0.001% to 1.000%;
Mn: 0.40% to 3.00%;
sol. Al: 0.0002% to 0.5000%;
P: 0.100% or less;
S: 0.1000% or less;
N: 0.0100% or less;

Cu: 0% to 1.00%;
Ni: 0% to 1.00%;
Nb: 0% to 0.150%;
V: 0% to 1.000%;
Ti: 0% to 0.150%;
Mo: 0% to 1.000%;
Cr: 0% to 1.000%;
B: 0% to 0.0100%;
Ca: 0% to 0.010%;
REM: 0% to 0.300%; and
a remainder: Fe and an impurity,
the Al—Si alloy plating layer has a thickness of 7 to 148 μm,
the Ni plating layer has a thickness of more than 200 nm and 2500 nm or less, and
wherein a metallographic structure of the base material, in terms of an area ratio in a cross section, an area ratio of ferrite is 20 to 80%, an area ratio of pearlite is 20 to 80% and an area ratio of a remainder in microstructure is less than 5%.

2. The steel sheet for hot stamping according to claim 1, wherein the Ni plating layer is provided in direct contact with the Al—Si alloy plating layer as an upper layer of the Al—Si alloy plating layer.

3. The steel sheet for hot stamping according to claim 1, wherein the chemical composition of the base material contains, by mass %, one or more selected from the group of:
Cu: 0.005% to 1.000%;
Ni: 0.005% to 1.000%;
Nb: 0.010% to 0.150%;
V: 0.005% to 1.000%;
Ti: 0.010% to 0.150%;
Mo: 0.005% to 1.000%;
Cr: 0.050% to 1.000%;
B: 0.0005% to 0.0100%;
Ca: 0.001% to 0.010%; and
REM: 0.001% to 0.300%.

4. The steel sheet for hot stamping according to claim 1, wherein a dislocation density at a depth of 100 μm from a surface of the base material is $5\times10^{13}$ m/m$^3$ or more.

5. The steel sheet for hot stamping according to claim 2, wherein the chemical composition of the base material contains, by mass %, one or more selected from the group of:
Cu: 0.005% to 1.000%;
Ni: 0.005% to 1.000%;
Nb: 0.010% to 0.150%;
V: 0.005% to 1.000%;
Ti: 0.010% to 0.150%;
Mo: 0.005% to 1.000%;
Cr: 0.050% to 1.000%;
B: 0.0005% to 0.0100%;
Ca: 0.001% to 0.010%; and
REM: 0.001% to 0.300%.

6. The steel sheet for hot stamping according to claim 2, wherein a dislocation density at a depth of 100 μm from a surface of the base material is $5\times10^{13}$ m/m$^3$ or more.

7. The steel sheet for hot stamping according to claim 3, wherein a dislocation density at a depth of 100 μm from a surface of the base material is $5\times10^{13}$ m/m$^3$ or more.

8. The steel sheet for hot stamping according to claim 1, wherein the Ni plating layer has a thickness of 280 to 2500 nm.

9. The steel sheet for hot stamping according to claim 1, wherein the Ni plating layer has a thickness of 350 to 2500 nm.

10. The steel sheet for hot stamping according to claim 1, wherein the Al oxide coating has a thickness of 0 to 3 nm.

* * * * *